US010545444B2

(12) United States Patent
Okada

(10) Patent No.: US 10,545,444 B2
(45) Date of Patent: Jan. 28, 2020

(54) IMAGE FORMING APPARATUS

(71) Applicant: CANON KABUSHIKI KAISHA, Tokyo (JP)

(72) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/951,276

(22) Filed: Apr. 12, 2018

(65) Prior Publication Data

US 2018/0307167 A1 Oct. 25, 2018

(30) Foreign Application Priority Data

Apr. 25, 2017 (JP) ..... 2017-086007

(51) Int. Cl.

| | |
|---|---|
| ***G03G 15/00*** | (2006.01) |
| ***G03G 15/05*** | (2006.01) |
| ***G03G 15/08*** | (2006.01) |
| *G03G 15/10* | (2006.01) |

(52) U.S. Cl.

CPC ..... *G03G 15/5004* (2013.01); *G03G 15/05* (2013.01); *G03G 15/0808* (2013.01); *G03G 15/105* (2013.01)

(58) Field of Classification Search

CPC ..... G03G 15/5004

See application file for complete search history.

(56) References Cited

U.S. PATENT DOCUMENTS

| | | | |
|---|---|---|---|
| 8,805,221 | B2 | 8/2014 | Okada |
| 9,645,527 | B2 | 5/2017 | Saito et al. |
| 9,811,022 | B2 | 11/2017 | Okada |

FOREIGN PATENT DOCUMENTS

| | | | |
|---|---|---|---|
| JP | H10-039608 | A | 2/1998 |
| JP | 2006-308941 | A | 11/2006 |
| JP | 2008-122466 | A | 5/2008 |
| JP | 2010-066420 | A | 3/2010 |
| JP | 2011-048118 | A | 3/2011 |

*Primary Examiner* — David M. Gray
*Assistant Examiner* — Andrew V Do
(74) *Attorney, Agent, or Firm* — Venable LLP

(57) ABSTRACT

An image forming apparatus includes a calculation portion that calculates an image ratio of the electrostatic image to be formed. A controller controls developer supply from a developer supplier to a developing unit based on the toner density output of an inductance sensor. An adjustment portion adjusts the density of the toner output from the toner density detection portion to a higher value in a case where the image ratio calculated by the calculation portion is higher than a predetermined image ratio.

13 Claims, 15 Drawing Sheets

IMAGE FORMING APPARATUS

BACKGROUND OF THE INVENTION

Field of the Invention

The present invention relates to an image forming apparatus including a developing unit configured to form a toner image by supplying developer constituted by toner and carrier to an electrostatic image formed on an image bearing member.

Description of the Related Art

Generally, in a developing unit of an image forming apparatus of an electrophotographic system or an electrostatic recording system, one-component developer including magnetic toner as a main component or two-component developer including nonmagnetic toner and magnetic carrier as main components is used. In developing units of many image forming apparatuses that form full-color or multicolor images by an electrophotographic system, two-component developer is used from the viewpoint of color tone of an image.

In particular, a toner density TD of two-component developer is a very important factor in stabilizing image quality. For this toner density TD, a ratio of toner weight T to a total weight D of carrier and toner, that is, a so-called TD ratio is widely used.

Generally, at the time of development, toner in developer is consumed and the toner density of the developer in the developing unit decreases, in other words, is lowered. Therefore, there has been known a technique of replenishing toner in accordance with the toner density of the developer or an image density detected by a suitable means. By controlling the toner density of the developer or the image density, image quality can be maintained for a plurality of times of image formation.

As specific examples of a method of controlling the density of developer of this kind, the following methods are known. First, there is a developer density detection ATR system in which the toner density of developer in a developing unit is controlled by detecting the amount of light reflection of the developer or the magnetic permeability of the developer by a toner density sensor. Here, ATR stands for Automatic Toner Replenisher. As a toner density detection portion for this developer density detection ATR system, an optical sensor or an inductance sensor is used. In addition, there is known a so-called patch detection ATR system in which an image pattern for image density detection serving as a patch image is formed on an electrophotographic photosensitive member and control is performed by detecting the image density of the image pattern by a sensor such as an image density sensor disposed so as to oppose the photosensitive member. Further, there is known a so-called video count ATR system in which control is performed by calculating a required amount of toner on the basis of an output level of a digital image signal of each pixel from a video counter as disclosed in Japanese Patent Laid-Open No. 10-039608.

In all of these systems, control is performed to keep the toner density of developer or the image density constant by controlling supply of toner to the developer in the developing unit by controlling, for example, the rotation of a motor that drives a toner supplying portion.

However, the conventional toner density control as described above has the following problem. That is, in the case where a sensor, which is an inductance sensor here, that detects the magnetic permeability of the developer is used for a developer density detection ATR, the bulk density of the developer needs to be constant to accurately detect the TD ratio. However, the bulk density of actual developer changes in accordance with the amount of frictional charge of toner in the developer. The output value of the inductance sensor also changes in accordance with the environment or the wear of the developer, and this may cause erroneous detection of the TD ratio.

Regarding this point, for example, there is known a technique of controlling a control voltage of an inductance sensor in accordance with the humidity and accumulated driving time after start of use of the developing unit as disclosed in Japanese Patent Laid-Open No. 2008-122466. The intention of this configuration is to suppress erroneous detection of the TD ratio caused by an environmental factor and a carrier degradation factor.

Although erroneous detection of the TD ratio caused by an environmental factor and a carrier degradation can be suppressed by the technique of Japanese Patent Laid-Open No. 2008-122466, this can cause the following problems.

For example, in the case where images of large image ratios are successively formed, new developer that has not been sufficiently agitated is supplied to the developing unit corresponding to the consumption of toner. As a result of this, the amount of frictional charge of toner of the developer decreases and the bulk density of the developer increases, and thus there is a possibility that the inductance sensor erroneously detects the TD ratio. In the case where toner is supplied to keep the output value of the inductance sensor constant in this state, the TD ratio increases, thus the amount of frictional charge of toner of the developer further decreases, and the bulk density further increases. Due to such a mechanism, there is a possibility that the erroneous detection of the TD ratio continues. As a method for solving this problem, another method of toner density control, for example, a method of correcting density control by patch detection ATR control can be considered as disclosed in Japanese Patent Laid-Open No. 10-039608. However, the correction of density control should be frequently performed in a situation, for example, while images of large image ratios are successively formed. Therefore, the patch detection ATR control in which a patch image actually formed needs to be measured is not suitable, and there is a possibility that the productivity of the image forming apparatus is greatly lowered in the case where the patch detection ATR control is used for such correction of density control.

SUMMARY OF THE INVENTION

The present invention provides an image forming apparatus configured to control toner density properly even if an image ratio of the image formed on sheets varies.

According to one aspect of the present invention, an image forming apparatus includes an image bearing member on which an electrostatic image is to be formed, a developing unit having a developer bearing member configured to carry and convey developer having toner and carrier to develop the electrostatic image, the developing unit being configured to accommodate the developer, an inductance sensor configured to output a voltage value corresponding to a density of the toner in the developer in the developing unit, a calculation portion configured to calculate an image ratio of the electrostatic image to be formed on the image bearing member, a developer supplying portion configured to supply the developer to the developing unit, a controller configured to control the developer supplied from the developer supplying portion to the developing unit on a basis of the density of the toner output from the inductance sensor, and a voltage controller configured to control an absolute value of an adjusting voltage value to a second voltage value smaller than a first voltage value in a case where an averaged image ratio of a predetermined number of the electrostatic images is a second image ratio larger than a first image ratio. The adjusting voltage value is a voltage value for adjusting a magnitude of a magnetic field of the inductance sensor. The first voltage value is an absolute value of the adjusting voltage value in a case where the averaged image ratio of the predetermined number of the electrostatic images is the first image ratio.

According to another aspect of the present invention, an image forming apparatus includes an image bearing member on which an electrostatic image is to be formed, a developing unit having a developer bearing member configured to carry and convey developer having toner and carrier to develop the electrostatic image, the developing unit being configured to accommodate the developer, a toner density detection portion configured to detect a density of the toner in the developer in the developing unit, a calculation portion configured to calculate an image ratio of the electrostatic image to be formed on the image bearing member, an adjustment portion configured to adjust the density of the toner output from the toner density detection portion to a higher value in a case where an averaged image ratio of a predetermined number of the electrostatic images is higher than a predetermined image ratio, a developer supplying portion configured to supply the developer to the developing unit, and a controller configured to execute a first supply mode and a second supply mode. In the first supply mode, the controller controls the developer to be supplied from the developer supplying portion to the developing unit on a basis of the density of the toner output from the toner detection portion that has not been adjusted by the adjustment portion, while in the second supply mode, the controller controls the developer to be supplied from the developer supplying portion to the developing unit on a basis of the density of the toner that has been adjusted by the adjustment portion.

According to another aspect of the present invention, an image forming apparatus includes an image bearing member on which an electrostatic image is to be formed, a developing unit having a developer bearing member configured to carry and convey developer having toner and carrier to develop the electrostatic image, the developing unit being configured to accommodate the developer, an inductance sensor configured to output a voltage value corresponding to a density of the toner in the developer in the developing unit, a developer supplying portion configured to supply the developer to the developing unit, a controller configured to control the developer supplied from the developer supplying portion to the developing unit on a basis of the density of the toner output from the inductance sensor, and a voltage controller configured to control an absolute value of an adjusting voltage value to a second voltage value smaller than a first voltage value in a case where images of a second image ratio larger than a first image ratio are successively formed. The adjusting voltage value is a voltage value for adjusting a magnitude of a magnetic field of the inductance sensor. The first voltage value is the absolute value of the adjusting voltage value in a case where images of the first image ratio are successively formed.

According to another aspect of the present invention, an image forming apparatus includes an image bearing member on which an electrostatic image is to be formed, a developing unit having a developer bearing member configured to carry and convey developer having toner and carrier to develop the electrostatic image, the developing unit being configured to accommodate the developer, an inductance sensor configured to output a voltage value corresponding to a density of the toner in the developer in the developing unit, a developer supplying portion configured to supply the developer to the developing unit, and a controller configured to control the developer supplied from the developer supplying portion to the developing unit on a basis of the density of the toner output from the inductance sensor. When images of image ratios larger than 80% are successively formed after successively forming a predetermined number of images of image ratios smaller than 10%, the controller controls the developer supplying portion such that difference between the density of the toner based on the inductance sensor and an actual density of the toner in the developer in the developing unit becomes smaller.

According to another aspect of the present invention, an image forming apparatus includes an image bearing member on which an electrostatic image is to be formed, a developing unit having a developer bearing member configured to carry and convey developer having toner and carrier to develop the electrostatic image, the developing unit being configured to accommodate the developer, an inductance sensor configured to output a voltage value corresponding to a density of the toner in the developer in the developing unit, a calculation portion configured to calculate an image ratio of the electrostatic image to be formed on the image bearing member, a developer supplying portion configured to supply the developer to the developing unit, a controller configured to control the developer supplied from the developer supplying portion to the developing unit on a basis of the density of the toner output from the inductance sensor, and a voltage controller configured to control an absolute value of an adjusting voltage value to a second voltage value smaller than a first voltage value in a case where the image ratio calculated by the calculation portion is a second image ratio larger than a first image ratio. The adjusting voltage value is a voltage value for adjusting a magnitude of a magnetic field of the inductance sensor, and the first voltage value is an absolute value of the adjusting voltage value in a case where the image ratio calculated by the calculation portion is the first image ratio.

According to another aspect of the present invention, an image forming apparatus includes an image bearing member on which an electrostatic image is to be formed, a developing unit having a developer bearing member configured to carry and convey developer having toner and carrier to develop the electrostatic image, the developing unit being configured to accommodate the developer, a toner density detection portion configured to detect a density of the toner in the developer in the developing unit, a calculation portion configured to calculate an image ratio of the electrostatic image formed on the image bearing member, an adjustment portion configured to adjust the density of the toner output from the toner density detection portion to a higher value in a case where the image ratio calculated by the calculation portion is higher than a predetermined image ratio, a developer supplying portion configured to supply the developer to the developing unit, and a controller configured to execute a first supply mode and a second supply mode. In the first supply mode, the controller controls the developer to be supplied from the developer supplying portion to the developing unit on a basis of the density of the toner output from the toner detection portion that has not been adjusted by the adjustment portion, while in the second supply mode, the controller controls the developer to be supplied from the developer supplying portion to the developing unit on a basis of the density of the toner that has been adjusted by the adjustment portion.

Further features of the present invention will become apparent from the following description of exemplary embodiments with reference to the attached drawings.

BRIEF DESCRIPTION OF THE DRAWINGS

FIG. 4A illustrating change in an image ratio, FIG. 4B illustrating change in control voltage of an inductance sensor, FIG. 4C illustrating change in a TD ratio detected via the inductance sensor, and FIG. 4D illustrating change in an actual TD ratio.

FIG. 5A illustrating change in the image ratio, FIG. 5B illustrating change in the TD ratio controlled to be substantially constant by manual control, FIG. 5C illustrating change in an amount of charge of toner, and FIG. 5D illustrating change in the TD ratio detected via the inductance sensor.

FIG. 6A illustrating change in the image ratio, FIG. 6B illustrating change in the control voltage of the inductance sensor, FIG. 6C illustrating change in the TD ratio detected via the inductance sensor, and FIG. 6D illustrating change in the actual TD ratio.

FIG. 11A illustrating change in the image ratio, FIG. 11B illustrating change in the control voltage of the inductance sensor, FIG. 11C illustrating change in the TD ratio detected via the inductance sensor, and FIG. 11D illustrating change in the actual TD ratio.

FIG. 12A illustrating change in the image ratio, FIG. 12B illustrating change in the control voltage of the inductance sensor, FIG. 12C illustrating change in the TD ratio detected via the inductance sensor, and FIG. 12D illustrating change in the actual TD ratio.

FIG. 14A illustrating change in the image ratio, FIG. 14B illustrating change in the control voltage of the inductance sensor, FIG. 14C illustrating change in the TD ratio detected via the inductance sensor, and FIG. 14D illustrating change in the actual TD ratio.

DESCRIPTION OF THE EMBODIMENTS

Exemplary embodiments of the present invention will be described below with reference to attached drawings. To be noted, configurations shown below are merely examples, and the detailed configurations may be appropriately modified by one skilled in the art within the scope of the present invention. Further, numeric values shown in the exemplary embodiments are merely values for reference and do not limit the present invention.

Basic Configuration of Developing Unit and Image Forming Apparatus

Figure 1:
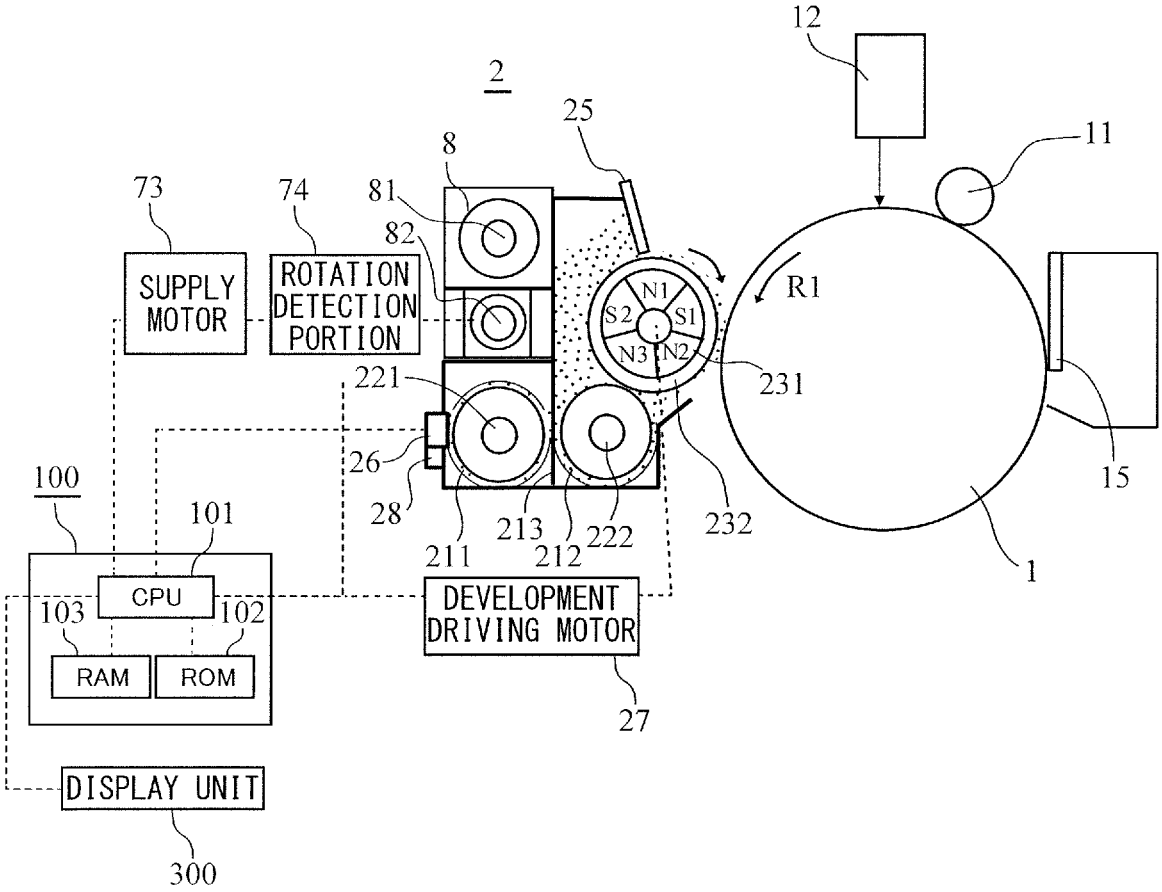
FIG. 1 is an explanatory diagram illustrating a configuration around a photosensitive drum of an image forming apparatus in which the present invention can be implemented.

FIG. 1 illustrates a configuration of an image forming portion disposed around a photosensitive drum of an image forming apparatus of a digital system in which the present invention can be implemented. In addition, FIG. 2 illustrates a schematic configuration of an image forming apparatus 10 including a photosensitive drum 1 of FIG. 1 as an image bearing member for image formation.

First, a configuration of the image forming apparatus 10 of FIG. 2 and a configuration around the photosensitive drum 1 of FIG. 1 will be described in detail. To be noted, FIG. 2 illustrates a configuration of a controller 100 of the image forming apparatus 10 and in particular a configuration of a control system that controls a developing unit 2 disposed around the photosensitive drum 1 in blocks.

Figure 2:
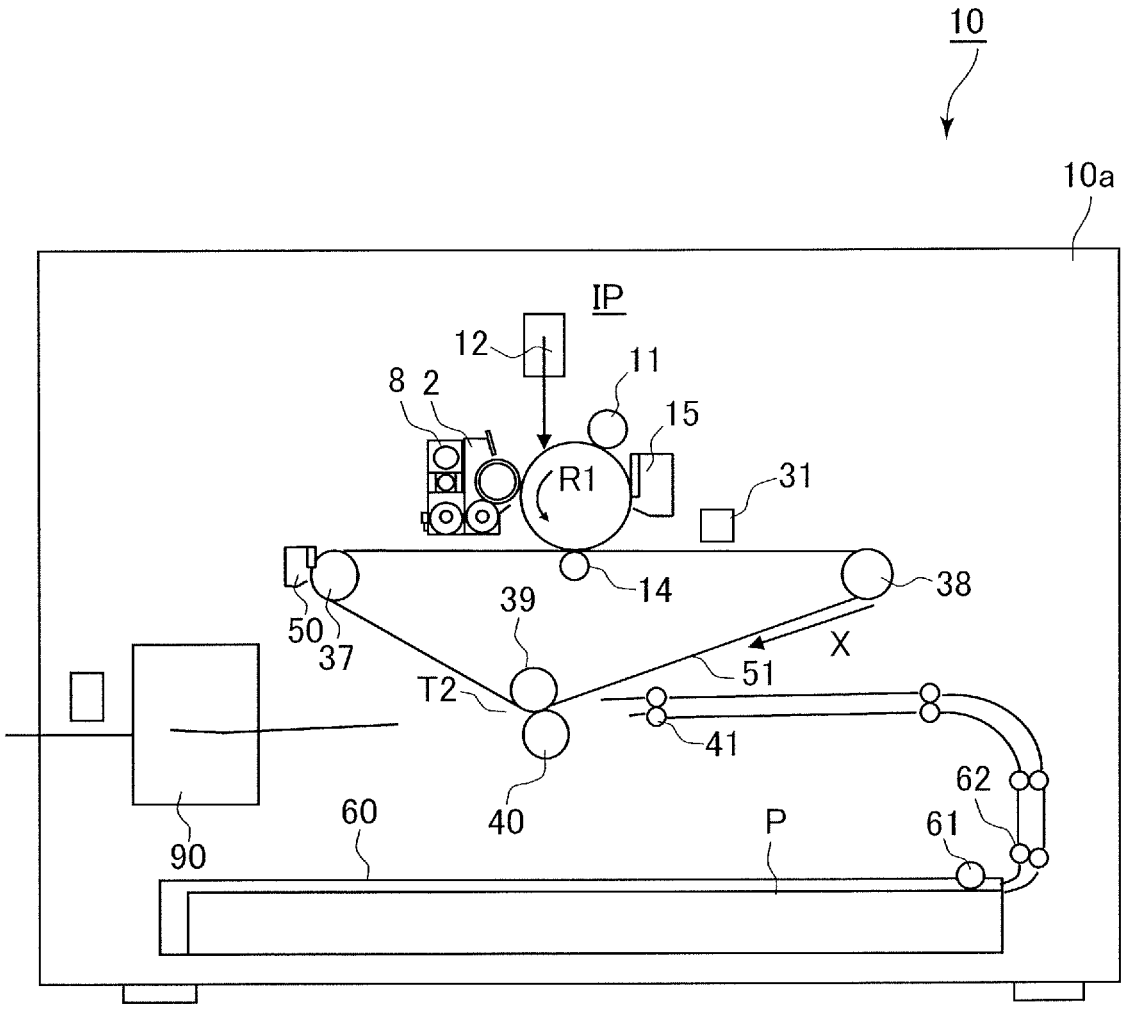
FIG. 2 is a section view of the image forming apparatus including the photosensitive drum of FIG. 1 illustrating a schematic configuration thereof.

As illustrated in FIG. 2, an intermediate transfer belt 51 is disposed in a housing 10*a* of the image forming apparatus 10. The intermediate transfer belt 51 is an endless belt that moves in an arrow X direction. The intermediate transfer belt 51 is stretched over a driving roller 37, a tension roller 38, and a secondary transfer inner roller 39, and is rotationally driven by the driving roller 37.

For example, a recording sheet P taken out from a sheet feeding cassette 60 by a pickup roller 61 is supplied to a conveyance system including conveyance rollers 41 and 62 and is further conveyed to the left in FIG. 2.

The image forming apparatus 10 performs color recording, and, in this case, four image forming portions IP having substantially the same configurations are disposed above the intermediate transfer belt 51. The configurations of the four image forming portions IP are substantially the same except that the colors of toner to be used for development, for example, four colors of C, M, Y, and K, are different. Therefore, in FIG. 2, only one image forming portion IP is schematically illustrated as a representative of the image forming portions IP.

As illustrated in FIG. 2, the image forming portion IP includes an electrophotographic photosensitive member 1 as an image bearing member on which an image is to be formed. The electrophotographic photosensitive member 1 is rotatably disposed and has a drum shape. The electrophotographic photosensitive member 1 will be hereinafter referred to as a photosensitive drum 1. The photosensitive drum 1 includes an unillustrated support shaft at the center thereof, and is rotationally driven in an arrow R1 direction about the support shaft by an unillustrated driving portion. Process devices such as a charging roller 11, a developing unit 2, a primary transfer roller 14, and a cleaning unit 15 are disposed around the photosensitive drum 1. The charging roller 11 serves as a primary charging unit.

The charging roller 11 has a roller shape as a whole, and uniformly, in other words, evenly charges the surface of the photosensitive drum 1 to a predetermined polarity and a predetermined potential. The charging roller 11 is rotated by the rotation of the photosensitive drum 1 in the arrow R1 direction in a state of being pressed against the surface of the photosensitive drum 1 by an unillustrated urging portion by a predetermined pressing force. In this case, for example, the charging roller 11 rotates in a direction opposite to the rotation of the photosensitive drum 1. A bias voltage is applied to an unillustrated core metal of the charging roller 11 by an unillustrated charging bias power source, and the surface of the photosensitive drum 1 in contact with the charging roller 11 is charged by the contact with the charging roller 11. In the present exemplary embodiment, for example, a bias voltage in which a direct current voltage and an alternate current voltage of 1.5 kVpp are superposed is applied to the core metal of the charging roller 11. By applying an alternate current voltage in this way, the potential on the photosensitive drum 1 can be converged to the same value as the voltage of the direct current voltage. For example, the potential of the surface of the photosensitive drum 1 after charging is −600 V in the case where the direct current bias voltage of the charging roller 11 is −600 V.

A scanner portion 12 is disposed downstream of the charging roller 11. The scanner portion 12 includes, for example, a laser light source and a scanning optical system, and irradiates the photosensitive drum 1 with laser light modulated by an image signal. Thus, an electrostatic latent image corresponding to the image signal is formed on the surface of the photosensitive drum 1. The intensity of the laser light of the scanner portion 12 can be changed in the range of, for example, 0 to 255, and, by changing the intensity of the laser light, the potential of the electrostatic latent image can be changed. To be noted, in the present exemplary embodiment, the potential on the photosensitive drum 1 in the case where laser light intensity L is changed in the range of 0 to 255 is expressed as V (L). The potential V (L) changes in the range of V (L=0) to V (L=255).

The developing unit 2 is disposed downstream of the scanner portion 12. The developing unit 2 serves as a developing portion that forms a toner image by supplying developer constituted by toner and carrier to an electrostatic image on the photosensitive drum 1 serving as a developing portion. In the developing unit 2 of the present exemplary embodiment, a two-component developing system in which two-component developer including nonmagnetic toner and magnetic carrier is used is employed. In addition, negatively chargeable toner is used in the present exemplary embodiment. However, the charging polarity does not limit the present invention, and the charging polarity of toner, the primary charging polarity of the charging roller 11, and the like do not have to be the same as the examples shown in the present exemplary embodiment.

The inside of the developing unit 2 is partitioned into a developing chamber 212 and an agitation chamber 211 by a partition wall 213 extending in a perpendicular direction at a developing position. A nonmagnetic developing sleeve 232 serving as a developer bearing member is disposed in the developing chamber 212, and a magnet 231 serving as a magnetic field generation portion is fixed inside the developing sleeve 232. The magnet 231 is configured to have, for example, three or more poles. In the present exemplary embodiment, a magnet of five poles of N1, S1, N2, N3, and S2 is used.

In the developing chamber 212 and the agitation chamber 211, a first conveyance screw 222 and a second conveyance screw 221 are respectively disposed as developer agitation/conveyance portions. The first conveyance screw 222 agitates and conveys developer in the developing chamber 212. In addition, the second conveyance screw 221 agitates and conveys toner supplied from a toner bottle 8 and developer already present in the developing unit 2, and thus makes the toner density of the developer uniform.

In the present exemplary embodiment, an inductance sensor 26 is provided. The inductance sensor 26 faces the agitation chamber 211 and detects the toner density, that is, the TD ratio of the developer. The inductance sensor 26 constitutes a toner density detection portion of the present exemplary embodiment, and is comprises, for example, a magnetic sensor capable of detecting the magnetic permeability of the developer in the agitation chamber 211.

Although specific details such as signal lines are not illustrated in FIG. 1, the inductance sensor 26 is connected to, for example, four lines respectively for an input voltage, a control voltage, an output voltage, and grounding, for input and output of signals. Among these, while a constant voltage is input as the input voltage, the control voltage serving as an adjusting voltage for controlling the magnitude of the magnetic field can be variably controlled, and thus, for example, the sensitivity of the inductance sensor 26 can be adjusted.

In the present exemplary embodiment, the toner density, that is, the TD ratio calculated by using the output of the inductance sensor 26 is stabilized by changing the control voltage of the inductance sensor 26. For example, as will be described later, the control voltage of the inductance sensor 26 is controlled in accordance with the image ratio of the image. Thus, erroneous value of the TD ratio detected via the inductance sensor 26 caused by the change in the bulk density of the developer derived from the change in the image ratio can be suppressed. That is, deviation of the TD ratio detected via the inductance sensor 26 from the actual TD ratio of the developer in the agitation chamber 211 can be suppressed.

In FIG. 1, developer paths that cause the developing chamber 212 and the agitation chamber 211 of the developing unit 2 to communicate with each other are provided at end portions of the partition wall 213, which is disposed between the developing chamber 212 and the agitation chamber 211 of the developing unit 2, on the front and back side. The details of the developer paths are not illustrated herein. In this configuration, when toner is consumed by development and the toner density of the developer decreases, the developer in the developing chamber 212 moves to the agitation chamber 211 through one of the developer paths due to the conveyance force of the first conveyance screw 222 and the second conveyance screw 221. The developer whose toner density has been restored in the agitation chamber 211 moves to the developing chamber 212 through the other of the developer paths. The developing sleeve 232, the first conveyance screw 222, and the second conveyance screw 221 are driven by a development driving motor 27.

The two-component developer agitated by the first conveyance screw 222 is bound by magnetic force of a conveyance magnetic pole of the developing sleeve 232 for drawing up, and conveyed by the rotation of the developing sleeve 232. Here, this magnetic pole is, for example, the magnetic pole N3, and is referred to as a draw-up pole. The developer is sufficiently bound by a conveyance magnetic pole having a magnetic field density of a certain value or greater, and is conveyed by rotation while forming a magnetic brush. This magnetic pole is, for example, the magnetic pole S2, and is referred to as a cut pole.

A regulation blade 25 cuts a magnetic nap, and thus optimizes the thickness of a developer layer on a circumferential surface of the developing sleeve 232. The developer layer whose thickness has been adjusted by the regulation blade 25 is conveyed to a developing region opposing the photosensitive drum 1 by the conveyance magnetic pole N1 and the rotation of the developing sleeve 232. Then, a developing pole that is in the developing region, for example, the magnetic pole S1, forms a magnetic nap, and only toner is transferred to the electrostatic image on the photosensitive drum 1 by a developing bias applied to the developing sleeve 232. Thus, the electrostatic image on the surface of the photosensitive drum 1 is developed with toner.

A predetermined developing bias is applied to the developing sleeve 232 by an unillustrated developing bias power source serving as a developing bias output portion. In the present exemplary embodiment, a developing bias voltage in which a direct current voltage and an alternate current voltage are superposed is applied to the developing sleeve 232 by the developing bias power source. In the present exemplary embodiment, the direct current voltage is Dev DC=−500 V, and the alternate current voltage is Dev AC=1.3 KVpp.

A toner bottle 8 can be attached to the developing unit 2. A supply motor 73 simultaneously rotationally drives a lower toner conveyance screw 82 and an upper toner conveyance screw 81, and thus toner is supplied to the developing unit 2 through an unillustrated supply port of the toner bottle 8. The lower toner conveyance screw 82 and the upper toner conveyance screw 81 are driven together by the supply motor 73 via an unillustrated driving system including a gear, a chain, and so forth. The members described above constitute a developer supplying portion that supplies developer to the inside of the developing unit 2, for example, the agitation chamber 211 and the developing chamber 212.

In the present exemplary embodiment, a rotation detection portion 74 that detects, for example, the number of rotations of the lower toner conveyance screw 82 as an integer is disposed to control the amount of toner supplied from the toner bottle 8 to the developing unit 2. This rotation detection portion 74 is constituted by, for example, a rotary encoder.

A central processing unit: CPU 101 of a controller 100 detects the amount of rotation of the conveyance screw 82 via the rotation detection portion 74. For example, the amount of toner supplied by one rotation of a screw that is determined by the size and pitch of a blade of the screw can be stored in a read-only memory: ROM 102. Therefore, in the case of supplying toner, the CPU 101 performs toner supply control of driving the supply motor 73 by an amount corresponding to the number of rotations corresponding to a target amount of supplied toner while monitoring the amount of rotation via the rotation detection portion 74.

In FIG. 2, the primary transfer roller 14 is disposed downstream of the developing unit 2. Both end portions of the primary transfer roller 14 are urged by an unillustrated urging member such as a spring, and thus the circumferential surface of the primary transfer roller 14 is urged toward the circumferential surface of the photosensitive drum 1.

As illustrated in FIGS. 1 and 2, the cleaning unit 15 is disposed downstream of the primary transfer roller 14. Toner remaining on the photosensitive drum 1 is removed by a cleaning blade in the cleaning unit 15. As illustrated in FIG. 2, a patch detection sensor 31 can be disposed above the intermediate transfer belt 51. The patch detection sensor 31 detects a reflection density of a toner image on the intermediate transfer belt 51.

In FIG. 2, the recording sheet P taken out from the sheet feeding cassette 60 is kept waiting with the leading end thereof stopped at the conveyance rollers 41. Then, the recording sheet P is fed by the conveyance rollers 41 at such a timing that an image formed on the intermediate transfer belt 51 can be transferred onto a predetermined position on the recording sheet P. The toner image on the intermediate transfer belt 51 is transferred onto the recording sheet P by a secondary transfer bias applied to a secondary transfer outer roller 40 at a region T2 at which the secondary transfer inner roller 39 abuts the secondary transfer outer roller 40 with the intermediate transfer belt 51 interposed therebetween.

A cleaning unit 50 is disposed downstream of the secondary transfer inner roller 39 so as to oppose the intermediate transfer belt 51. A cleaning blade in the cleaning unit 50 removes toner remaining on the intermediate transfer belt 51.

The recording sheet P separated from the intermediate transfer belt 51 is conveyed to a fixing unit 90. The toner image transferred onto the recording sheet P is heated, pressurized, and thus melt-blended and fixed onto the recording sheet P by the fixing unit 90. Then, the recording sheet P is discharged to the outside of the image forming apparatus.

Toner Supply Control: Video Count ATR and Developer Density Detection ATR

Here, the basic part of toner supply control of the present exemplary embodiment, particularly the basic part of control of video count ATR and developer density detection ATR will be described.

As a result of development of the electrostatic image with toner by the developing unit 2, that is, as a result of toner being consumed by being transferred from the developing sleeve 232 to the photosensitive drum 1, the toner density of the developer in the developing unit 2 decreases. In response to this, control of supplying toner from the toner bottle 8 to the developing unit 2, that is, toner supply control, is performed, and thus the toner density of the developer or the toner density of the developer and further the density of an image to be formed on the recording sheet P are controlled to be as constant as possible. The toner supply control or the toner density control of the present exemplary embodiment is mainly performed for each time of image formation, in other words, each sheet on which image formation is performed, by video count ATR or developer density detection ATR. In these two kinds of ATR control, control is performed on the basis of two kinds of information. The two kinds of information include a video count value Vc of image data with which the scanning light of the scanner portion 12 is modulated, and toner density, that is, a TD ratio, calculated from a detection result of the inductance sensor 26. The TD ratio is expressed by letters of TD. To be noted, patch detection ATR control mainly performed by using the patch detection sensor 31 at intervals longer than one time of image formation may be used in combination with the toner supply control or the toner density control.

Control procedures of the toner supply control or the toner density control of the present exemplary embodiment represented by the following mathematical expressions and flowchart can be stored, for example, in the ROM 102 as a control program of the CPU 101 of the controller 100. This control program of the CPU 101 is executed by, for example, using the RAM 103 as a work area.

An amount of supply M (N) at the time of image formation on the N-th sheet is calculated as follows by using the video count value Vc and the toner density TD calculated from the detection result of the inductance sensor 26 as described above.

For example, the video count value Vc is calculated from image data used for driving the scanner portion 12 in the image formation on the N-th sheet. A video count supply amount M_Vc calculated on the basis of the video count value Vc is calculated by, for example, multiplying the video count value Vc by a predetermined coefficient A_Vc as shown in Expression 1 below.

$$M_Vc(N)=Vc\times A_Vc \tag{1}$$

Here, the video count value Vc is, for example, a value corresponding to a portion to be developed with toner in the image data for the N-th sheet. Assignment of video count values Vc to numerical ranges may be arbitrarily selected. In the present exemplary embodiment, for example, the video count value Vc is 1023 when an image having an image ratio of 100%, that is, a full-area solid black image is output. This video count value Vc changes in accordance with the image ratio.

In the present exemplary embodiment, an inductance supply amount M_Indc (N) is calculated by using the toner density, that is, the TD ratio calculated from the detection result of the inductance sensor 26 and a predetermined coefficient. For example, the inductance supply amount M_Indc (N) is calculated as shown in Expression 2 below. That is, the inductance supply amount M_Indc (N) is calculated by multiplying a coefficient A_Indc by the difference between a TD ratio TD_Indc (N−1) calculated from a detection value of the inductance sensor 26 in the image formation on the (N−1)-th sheet and a target TD ratio TD_target.

$$M_\mathrm{Indc}(N)=(TD_\mathrm{target}-TD_\mathrm{Indc}(N-1))\times A_\mathrm{Indc} \tag{2}$$

To be noted, the coefficients A_Vc and A_Indc of Expressions 1 and 2 shown above are stored in the ROM 102 in advance. The value format in the case of storing a value corresponding to each value in the expressions described above in, for example, the RAM 103, may be arbitrarily selected. In the present exemplary embodiment, for example, in the case where the TD ratio is 8.0%, the value is recorded as a numerical value of 8.0. In addition, the value of the toner supply amount is recorded or managed in the order of milligrams. In the present exemplary embodiment, a setting of A_Indc=200 is recorded in the ROM 102.

The toner supply amount M (N) for the N-th sheet is calculated as shown in Expression 3 below on the basis of the video count supply amount M_Vc and the inductance supply amount M_Indc described above.

$$M(N)=M_Vc(N)+M_\mathrm{Indc}(N)+M_\mathrm{remain}(N-1) \tag{3}$$

Here, in Expression 3 shown above, M_remain (N−1) corresponds to a residual supply amount of toner remaining without being supplied in the image formation on the (N−1)-th sheet. An amount of supply of toner that does not reach the amount of toner supplied by one rotation of the screw is accumulated for the next image formation as the residual supply amount because the supply is performed by each rotation of the screw. In addition, in the case where M becomes smaller than 0, the M is regarded as 0 and control is performed such that no negative value is assigned to the supply amount.

Next, the number of rotations B of the supply motor 73 is calculated on the basis of the toner supply amount M. Here, an amount T of toner supplied to the developing unit 2 by one rotation of the lower toner conveyance screw 82 is recorded in the ROM 102 in advance. The number of rotations B of the supply motor 73 can be calculated, as shown in Expression 4 below, from the toner supply amount M calculated as shown in Expression 3.

$$B=M/T \tag{4}$$

Here, the number of rotations B is rounded down to an integer. In addition, in the present exemplary embodiment, the upper limit of B is set to 5 due to the restriction in the rotational speed of the supply motor 73. The decimal fraction part of B and the difference of B from 5 in the case where B is larger than 5 do not contribute to the amount of supplied toner, and thus the residual supply amount M_remain is calculated by Expression 5 below.

$$M_\mathrm{remain}=M-B\times T \tag{5}$$

In this way, the number of rotations B for rotationally driving the supply motor 73 in image formation for the N-th sheet is determined.

Settings of Control Voltage of Inductance Sensor

The description above relates to the basic part of the toner supply control or the toner density control. The base value of the control voltage of the inductance sensor 26 in the control described above can be determined on the basis of environmental information detected by an environmental sensor, for example, a humidity value (%), as indicated by a graph 301 in FIG. 3. This environmental information, for example, the humidity value is detected by the temperature/humidity sensor 28 disposed in the vicinity of the inductance sensor 26.

In the present exemplary embodiment, the toner density, or the TD ratio, of the developer in the developing unit 2 can be stably detected by changing the control voltage of the inductance sensor 26. The control of the control voltage of the inductance sensor 26 will be sequentially described in detail with reference to first to fourth exemplary embodiments and also to experimental results with which the control has been derived. To be noted, in the present exemplary embodiment, the target value of the TD ratio is set to 9%, and the supply control of the developer is performed such that the TD ratio is between the lower limit value of 7% and the upper limit value of 11%.

First Exemplary Embodiment

Figure 4A:
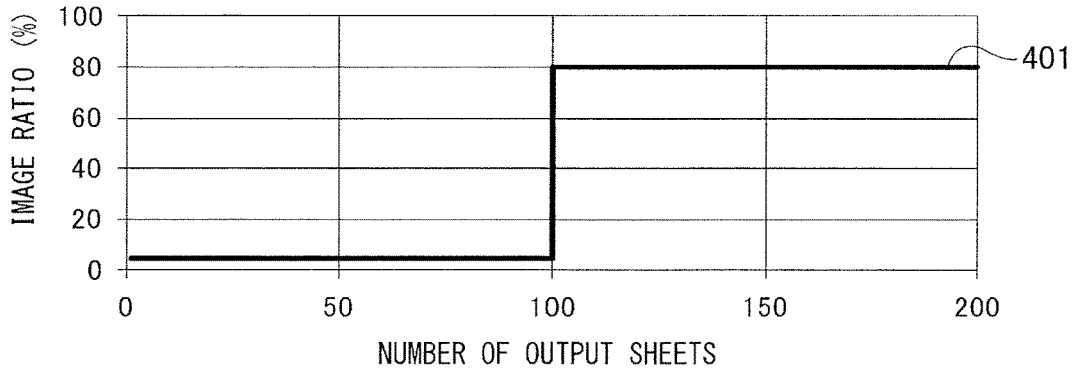
FIGS. 4A to 4D are explanatory diagrams illustrating erroneous detection of a TD ratio.
Figure 4B:
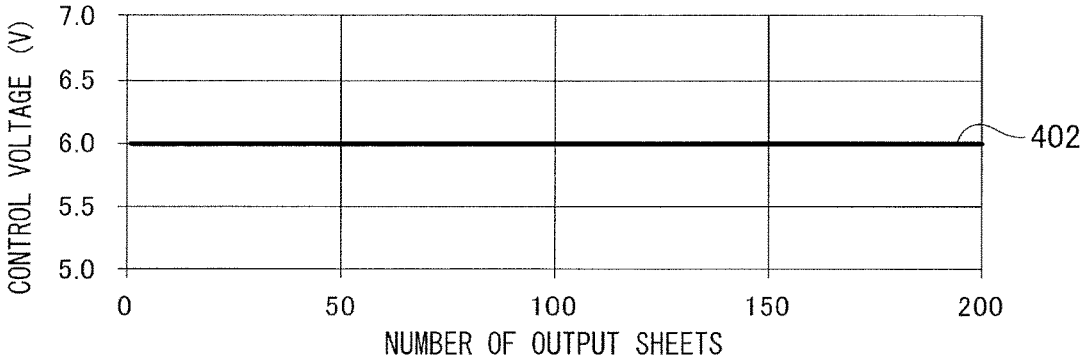
Figure 4C:
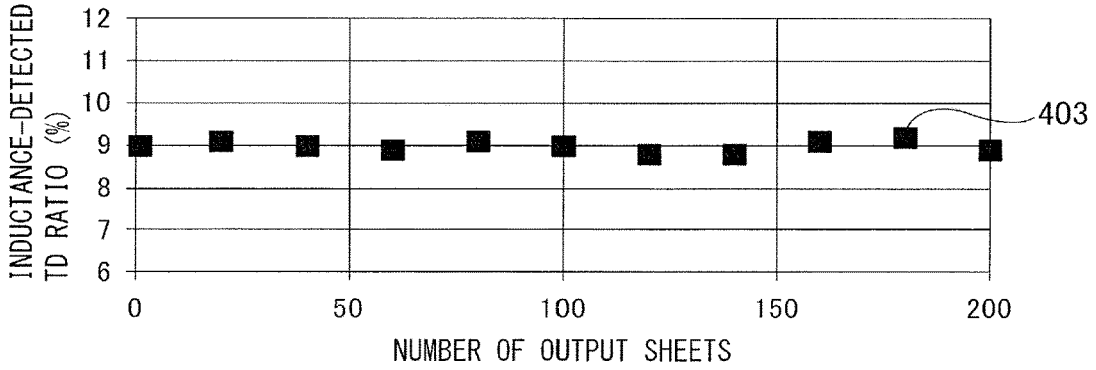
Figure 4D:
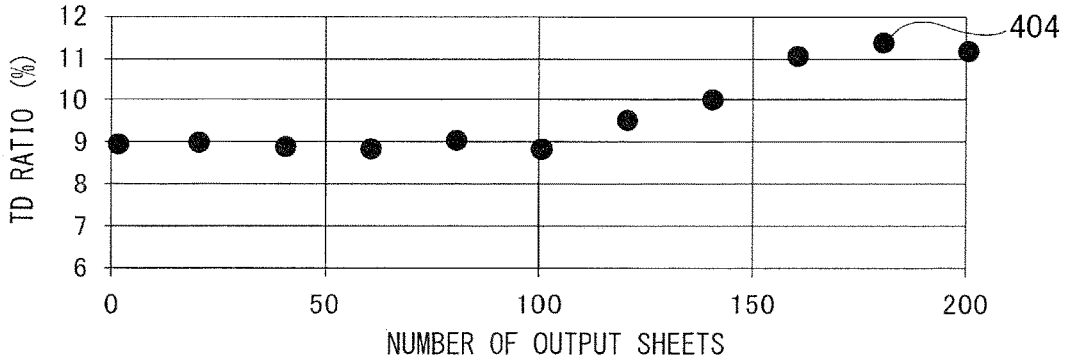

FIG. 4A illustrates a graph 401 indicating change in the image ratio when image formation is performed on a plurality of sheets. In FIG. 4A, image formation is performed at an image ratio of 5% on the 1st to 100th sheets, and is performed at an image ratio of 80% on the 101st to 200th sheets. FIG. 4B illustrates a graph 402 indicating change in the control voltage of the inductance sensor 26 in the image formation of FIG. 4A. In this example, the control voltage is a fixed value of 6.0 V. FIG. 4C illustrates a graph 403 indicating change in an inductance-detected TD ratio in the setting of control voltage illustrated in FIG. 4B. FIG. 4D illustrates a graph 404 indicating change in a TD ratio corresponding to the actual toner density of the developer in the developing unit 2 detected by other appropriate means in the setting of control voltage illustrated in FIG. 4B.

Here, the inductance-detected TD ratio indicated by the graph 403 in FIG. 4C is a TD ratio calculated on the basis of a detection value of the inductance sensor 26. In contrast, the TD ratio of FIG. 4D is a TD ratio corresponding to the actual toner density of the developer in the developing unit 2.

In this example of control of FIGS. 4A to 4D, a target TD ratio TD_target is 9.0%. In addition, the humidity value detected by the temperature/humidity sensor 28 at the time of image formation is constant at 50%, and the control voltage of the inductance sensor 26 indicated by the graph 402 is a fixed value of 6.0 corresponding to this humidity in the setting of FIG. 3.

Here, observing the example of control of FIGS. 4A to 4D, it can be seen that the TD ratio of the developer gradually increases after the image ratio has been raised to 80% at the 101st sheet although the inductance-detected TD ratio detected and calculated by the inductance sensor 26 is steady around 9%.

Figure 5A:
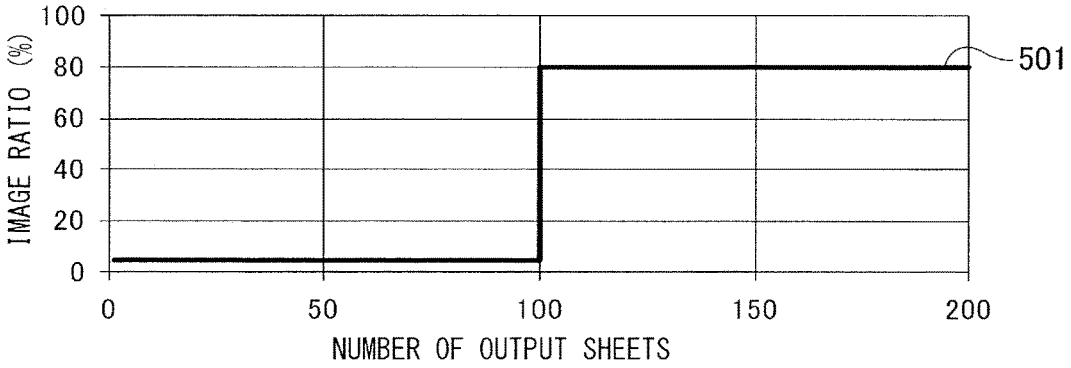
FIGS. 5A to 5D are explanatory diagrams illustrating results of an experiment of a first exemplary embodiment.

FIGS. 5A to 5D illustrate results of an experiment conducted to investigate the cause of increase in the TD ratio in the example of control of FIGS. 4A to 4D. In the experiment, the control voltage of the inductance sensor 26 is fixed to 6.0V, image formation is performed on 200 sheets while changing the image ratio as in FIGS. 4A to 4D, and the toner amount is manually corrected. In the example of control of FIGS. 5A to 5D, the toner amount is manually corrected such that the TD ratio of the developer in the developing unit 2 is constant. FIG. 5A illustrates a graph 501 indicating change in the image ratio similarly to FIG. 4A. How the image ratio is changed is the same as in FIG. 4A, that is, the image ratio for the 1st to 100th sheets is 5%, and the image ratio for the 101st to 200th sheets is 80%.

Figure 5B:
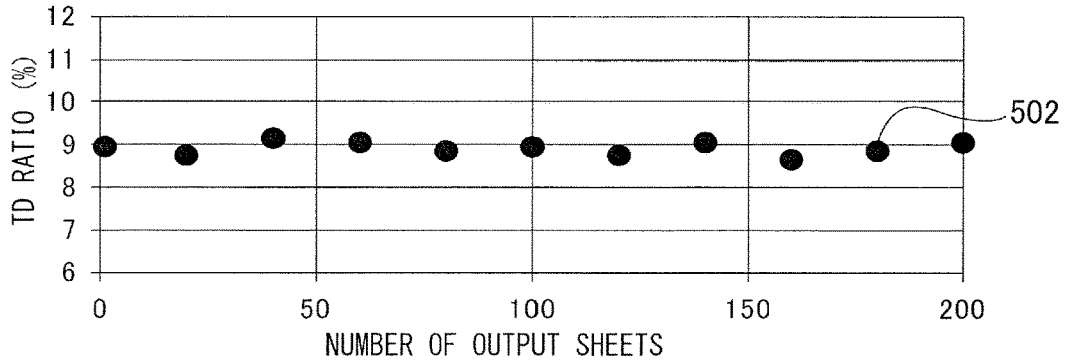

FIG. 5B illustrates a graph 502 indicating the TD ratio of the developer in the developing unit 2 controlled manually in image formation of FIG. 5A. Here, the toner amount is controlled such that the TD ratio indicated by the graph 502 is substantially constant at 9%.

Figure 5C:
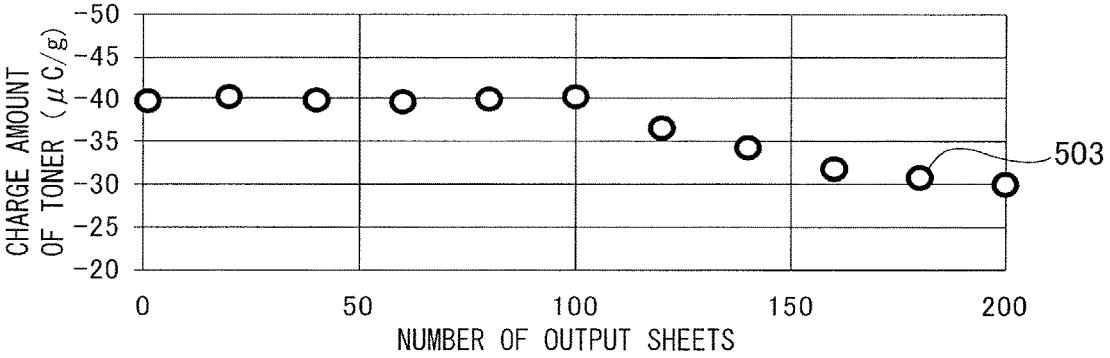
Figure 5D:
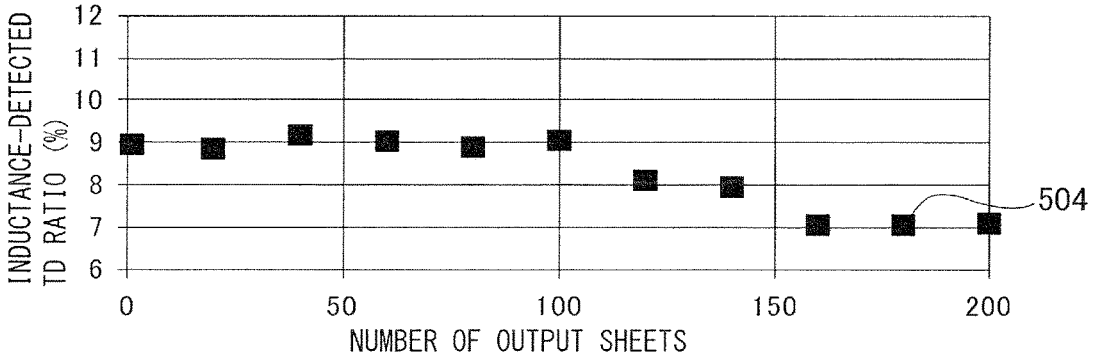

FIG. 5C illustrates a graph 503 indicating change in the charge amount of toner (μC/g) in the developer in the developing unit 2 measured by an unillustrated measurement portion. In addition, FIG. 5D illustrates a graph 504 indicating change in the inductance-detected TD ratio calculated on the basis of the detection result of the inductance sensor 26 in the image formation of FIG. 5A.

Observing FIG. 5C, after the image ratio is raised to 80% at the 101st sheet, it can be seen that, although the TD ratio of the developer in the developing unit 2 is maintained around 9% as illustrated in FIG. 5B, the charge amount of toner changes from −40 μC/g to −30 μC/g. Further, as a result of the decrease in the charge amount of toner, the bulk density of the developer increases and thus the inductance-detected TD ratio decreases as indicated by the graph 504 illustrated in FIG. 5D.

That is, erroneous detection in which the inductance-detected TD ratio is lower although the actual toner density, or the actual TD ratio, of the developer in the developing unit 2 is close to the target value, has occurred. Therefore, if the toner supply control is performed with the target TD ratio TD_target of 9.0% on the basis of the inductance-detected TD ratio calculated on the basis of the detection result of the inductance sensor 26, the toner is excessively supplied, and the TD ratio of the developer increases unintentionally.

In the present exemplary embodiment, a configuration of correcting erroneous detection of the inductance-detected TD ratio obtained via the inductance sensor 26 caused by the change in the charge amount of toner of the developer or the change in the bulk density of the developer derived from the change in the image ratio described above is provided. For example, in order to correct the erroneous detection of the inductance-detected TD ratio obtained by the inductance sensor 26, a method of changing the control voltage of the inductance sensor 26 when, for example, the image ratio changes can be considered. Therefore, to test this method, an experiment as illustrated in FIGS. 6A to 6D was conducted.

Figure 6A:
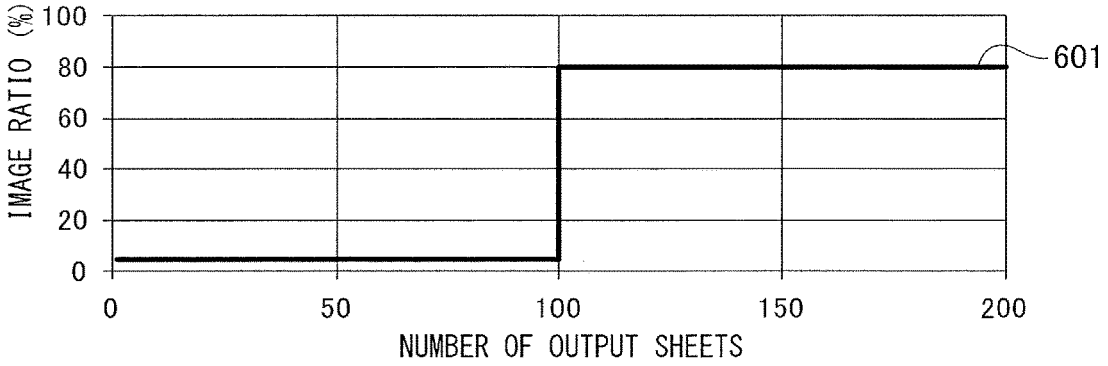
FIGS. 6A to 6D are explanatory diagrams illustrating toner density control in the first exemplary embodiment.
Figure 6B:
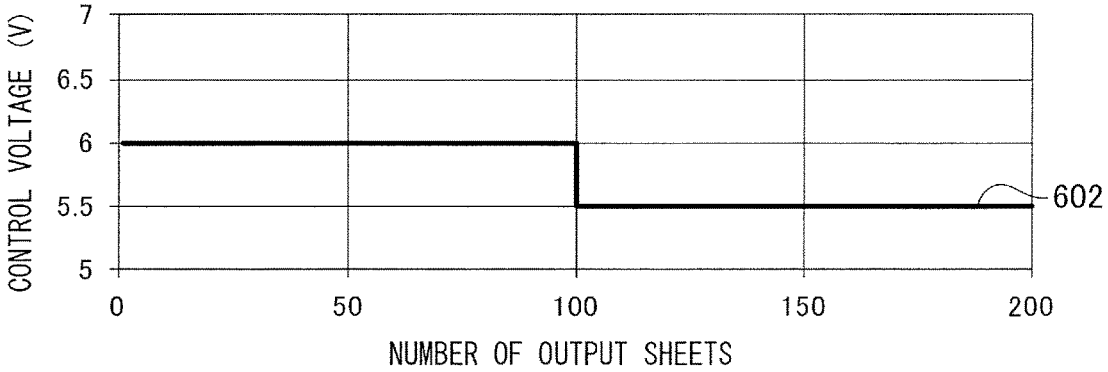

FIG. 6A illustrates a graph 601 indicating change in the image ratio in image formation on 200 sheets similarly to FIGS. 4A and 5A, and the image ratio for the 1st to 100th sheets is 5%, and the image ratio after the 100th sheet is 80%. In this example, as illustrated in FIG. 6B, a correction value of −0.5 V is applied to the control voltage of the inductance sensor 26 indicated by a graph 602 in synchronization with the change in the image ratio to 80% after the 100th sheet.

Figure 6C:
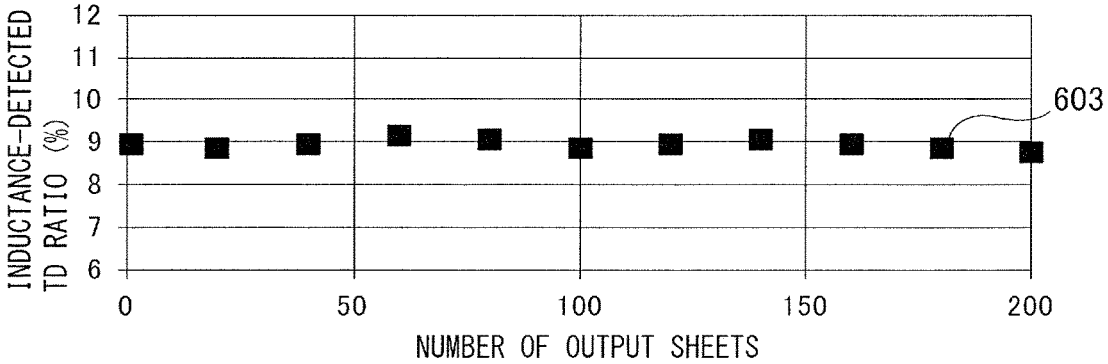
Figure 6D:
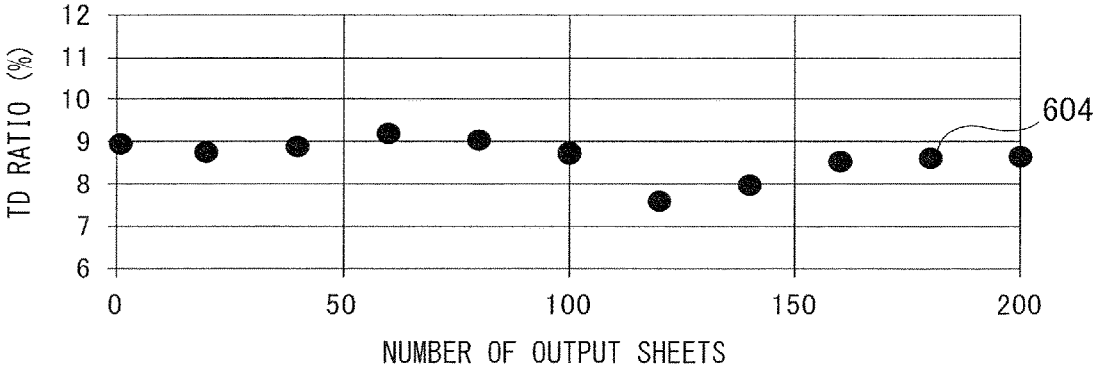

Further, FIG. 6C illustrates a graph 603 indicating change in the inductance-detected TD ratio calculated on the basis of the detection result of the inductance sensor 26 in the image formation of FIG. 6A. FIG. 6D illustrates a graph 604 indicating change in the TD ratio corresponding to the actual toner density of the developer in the developing unit 2 detected by other appropriate means.

In the experiment of FIGS. 6A to 6D, the control voltage of the inductance sensor 26 is changed from 6.0 V to 5.5 V by applying the correction value of −0.5 V to the control voltage of the inductance sensor 26 when the image ratio is changed to 80%. As a result of this, although a tendency that the TD ratio of the developer decreases in the region of the 120th to 140th sheets is observed, the TD ratio then increases to the vicinity of 9%. That is, the change in the TD ratio of the developer is suppressed compared with FIGS. 4A to 4D. In other words, it can be seen that the correction of changing the control voltage of the inductance sensor 26 in accordance with the change in the image ratio is effective. As described above, the difference between the inductance-detected TD ratio and the actual TD ratio of the developer can be reduced in the case where the control of the present exemplary embodiment is performed compared with the case where the control of the present exemplary embodiment is not performed, as illustrated in FIGS. 5A to 5D and 6A to 6D.

Figure 7:
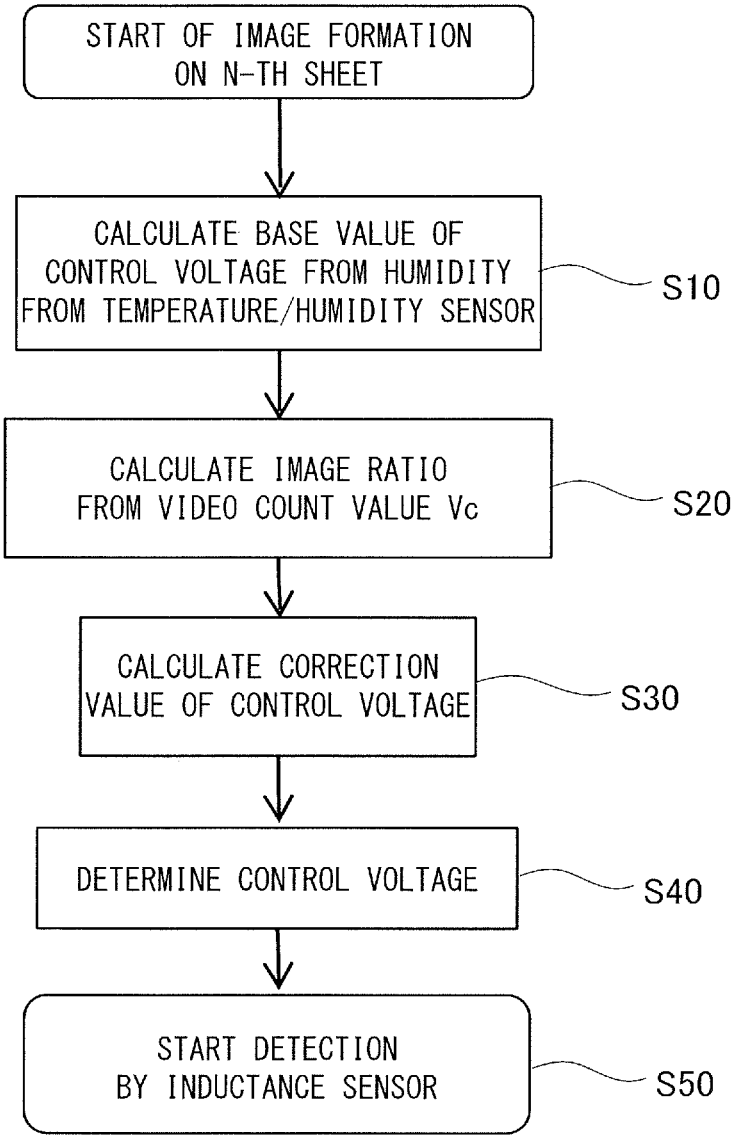
FIG. 7 is a flowchart illustrating a procedure of toner density control in the first exemplary embodiment.

FIG. 7 illustrates a part of the control procedure of the image formation of the present exemplary embodiment related to changing the control voltage of the inductance sensor 26 in accordance with the image ratio. The procedure of FIG. 7 can be stored in the ROM 102 as a control program for the CPU 101 of the controller 100. The same applies to the flowcharts that will be shown later.

Figure 3:
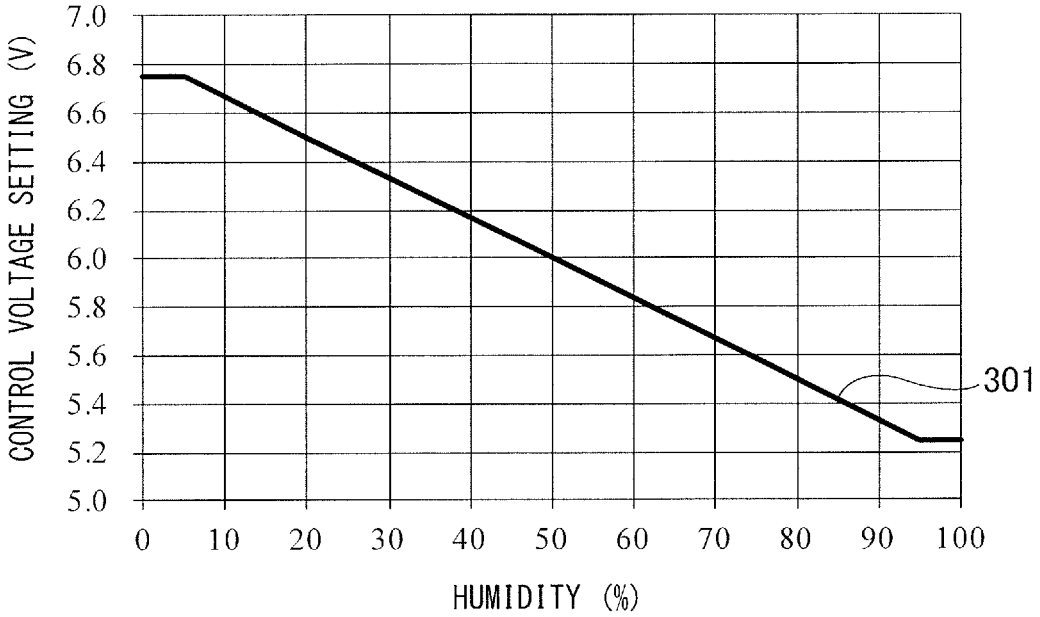
FIG. 3 is an explanatory diagram illustrating an example of setting of control voltage of an inductance sensor to be selected in accordance with a humidity value.

In step S10 of the control procedure of FIG. 7, first, at the start of image formation on the N-th sheet, a base value of the control voltage is calculated by using the humidity value of the temperature/humidity sensor 28 and the relationship of FIG. 3. Next, in step S20, the image ratio is calculated from the video count value Vc as shown in Expression 6 below.

(Image ratio for $N$-th sheet)=(Video count value for $N$-th sheet)/1023 (6)

Figure 8:
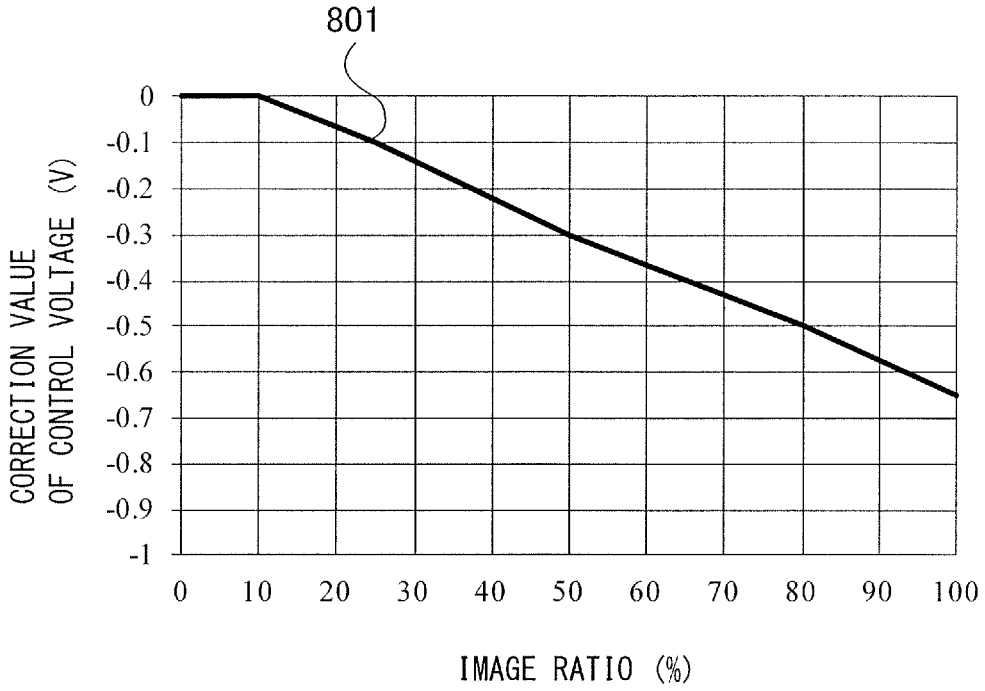
FIG. 8 is an explanatory diagram illustrating an example of setting of a correction value of the control voltage of the inductance sensor determined in accordance with the image ratio in the first exemplary embodiment.

Next, in step S30, the correction value of the control voltage of the inductance sensor 26 is calculated on the basis of the image ratio for the N-th sheet. FIG. 8 illustrates a graph 801 indicating an example of setting associating the image ratio with the correction value of the control voltage. For example, the functional relationship of FIG. 8 can be stored in the ROM 102 in the form of a data table that can be referred to on the basis of the image ratio. In step S40, the correction value of the inductance sensor 26 is calculated on the basis of, for example, such a functional relationship as illustrated in FIG. 8, and the control voltage is determined as shown in Expression 7 below.

(Value of control voltage)=(Base value of control voltage)+(Correction value of control voltage) (7)

Then, in step S50, detection of the inductance-detected TD ratio via the inductance sensor 26 is started by using the control voltage determined by Expression 7. The inductance-detected TD ratio calculated on the basis of the detection result of the inductance sensor 26 can be used as the TD ratio TD_Indc (N−1) of Expressions 1 to 4 described above, particularly Expression 2, in the calculation of the toner supply amount M for the next image formation.

As described above, according to the present exemplary embodiment, the erroneous detection of the inductance-detected TD ratio obtained via the inductance sensor 26 caused by the change in the charge amount of toner of the developer or the change in the bulk density of the developer derived from the change in the image ratio can be corrected. More specifically, the control voltage applied to the inductance sensor 26 is changed in accordance with the image ratio of the toner image to be formed on the photosensitive drum 1. As a result of this, the erroneous detection of the toner density can be suppressed in the toner density control using the inductance sensor 26 as a toner density detection portion even in the case where the image ratio of the image to be formed is changed. That is, the toner density can be appropriately controlled on the basis of the inductance-detected TD ratio detected via the inductance sensor 26, and thus an image of a high quality can be formed regardless of the change in the image ratio.

Second Exemplary Embodiment

In the first exemplary embodiment described above, only the basic part of control of changing the control voltage of the inductance sensor 26 in accordance with the change in the image ratio has been described. In the first exemplary embodiment, as illustrated in FIG. 6D, there is a case where counter correction, in other words, excessive supply, occurs immediately after the image ratio is changed to 80%. In the second exemplary embodiment, an example of control that addresses this counter correction will be described.

Figure 9:
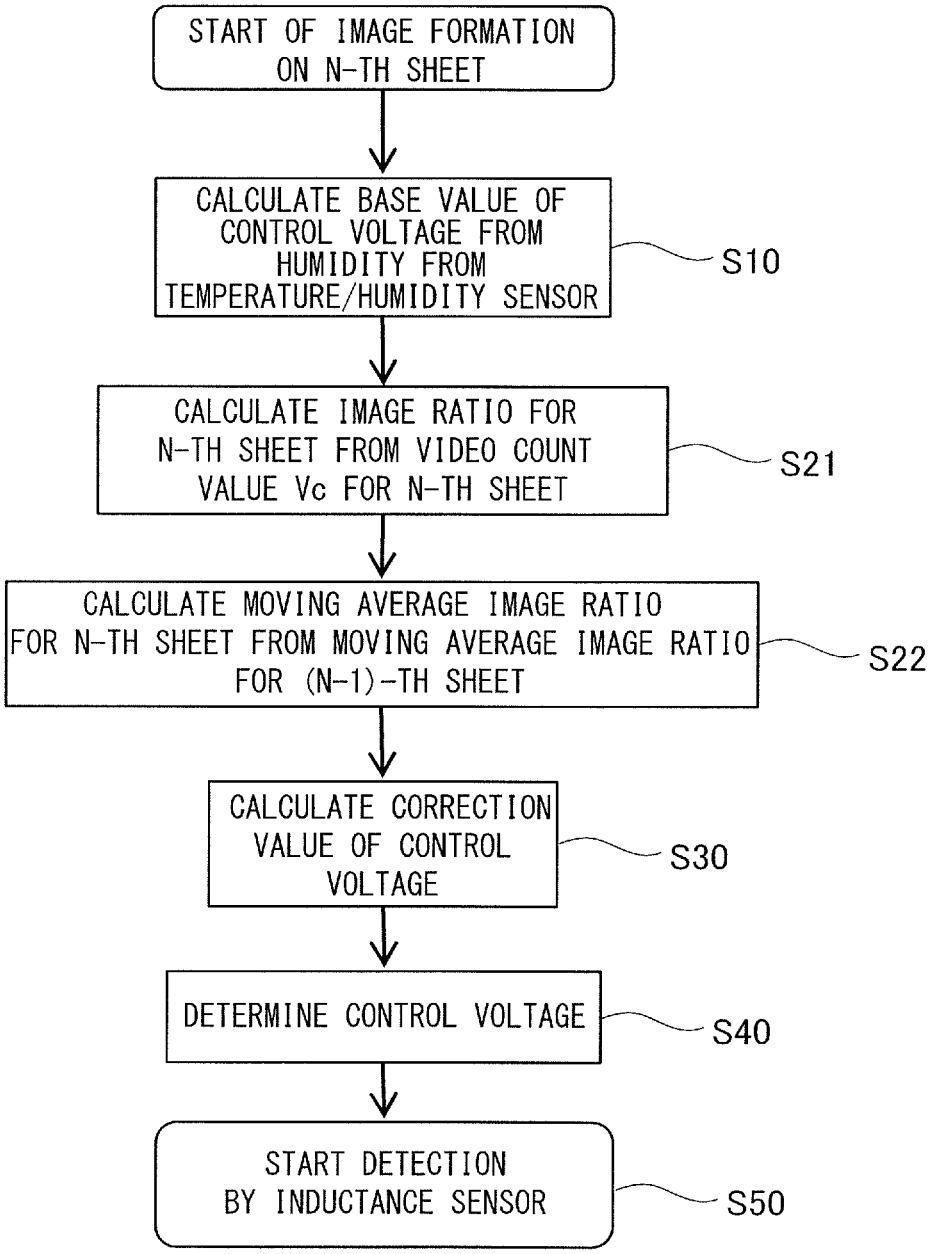
FIG. 9 is a flowchart illustrating a procedure of toner density control in a second exemplary embodiment.

FIG. 9 illustrates a part corresponding to changing the control voltage of the inductance sensor 26 of the control procedure of image formation in the second exemplary embodiment. To be noted, in the flowcharts that will be described below including FIG. 9, the same step numbers as in FIG. 7 will be assigned to steps of the same processes as in the control procedure of FIG. 7. For steps of similar processes to the control procedure of FIG. 7, step numbers with the same numbers in only the ten's places will be used.

The difference from the control procedure of FIG. 7 described above is that, after calculating the image ratio for the N-th sheet in step S21, a moving average image ratio serving as an adjusted moving average for the N-th sheet is calculated in step S22. Only parts different from the control of FIG. 7 will be described below. The same applies to the flowcharts below.

In FIG. 9, in step S21 corresponding to step S20 of FIG. 7, the image ratio for the N-th sheet is calculated, for example, as shown in Expression 6 shown above. Next, in step S22, the moving average image ratio for the N-th sheet is calculated from the image ratio for the N-th sheet and the moving average image ratio for the (N−1)-th sheet in accordance with Expression 8 below.

(Moving average image ratio for $N$-th sheet)=(Moving average image ratio for ($N$−1)-th sheet)×(α−1)/α+(Image ratio$f$ for $N$-th sheet)/α (8)

In this Expression 8 for calculating an exponential moving average, α is an exponent of the moving average, and is 50 in the present exemplary embodiment. That is, in the case where α is 50 in Expression 8, the moving average image ratio for the N-th sheet is calculated by assigning a weight of 49/50 to the moving average image ratio for the (N−1)-th sheet calculated in the image formation on the previous sheet, that is, the (N−1)-th sheet, and a weight of 1/50 to the image ratio for the N-th sheet of this time. That is, even if there is a large change in the image ratio at the N-th sheet, the control voltage of the inductance sensor 26 is determined by calculating the moving average of the image ratio, and thus the image ratio that has changed at the N-th sheet only acts with a small weight.

Figure 10:
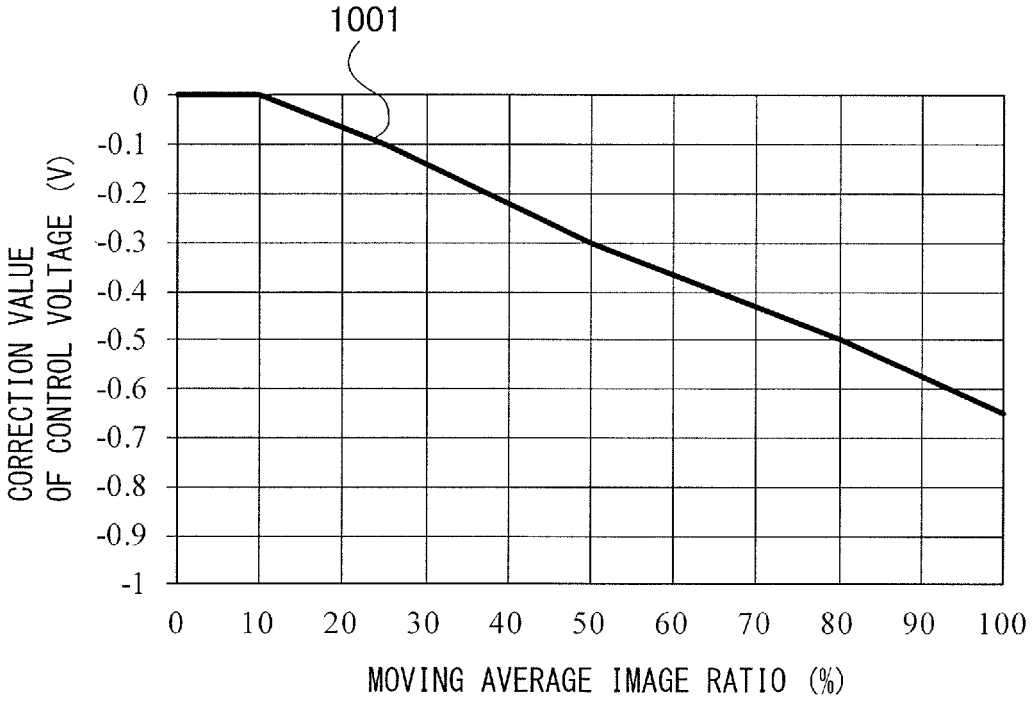
FIG. 10 is an explanatory diagram illustrating an example of setting of a correction value of the control voltage of the inductance sensor determined in accordance with the moving average of the image ratio in the second exemplary embodiment.

The moving average image ratio is updated as described above, and thus the correction value of the control voltage of the inductance sensor 26 is determined from the moving average image ratio for the N-th sheet of this time. FIG. 10 illustrates a graph 1001 indicating a functional relationship between the moving average image ratio and the correction value of the control voltage in the same form as FIG. 8. By using the functional relationship of FIG. 10, the correction value of the control voltage of the inductance sensor 26 can be determined from the moving average image ratio for the N-th sheet calculated as shown in Expression 8 described above. To be noted, the shapes of the curve of the linear functions of FIGS. 8 and 10 are the same, and only the values assigned to the horizontal axes are different. The image ratio (%) is assigned to the horizontal axis in FIG. 8, and the moving average image ratio for the N-th sheet (%) is assigned to the horizontal axis in FIG. 10. To be noted, a functional relationship different from the case of the image ratio not incorporating moving average may be assigned as the functional relationship between the moving average image ratio and the correction value of the control voltage indicated by the graph 1001.

Figure 11A:
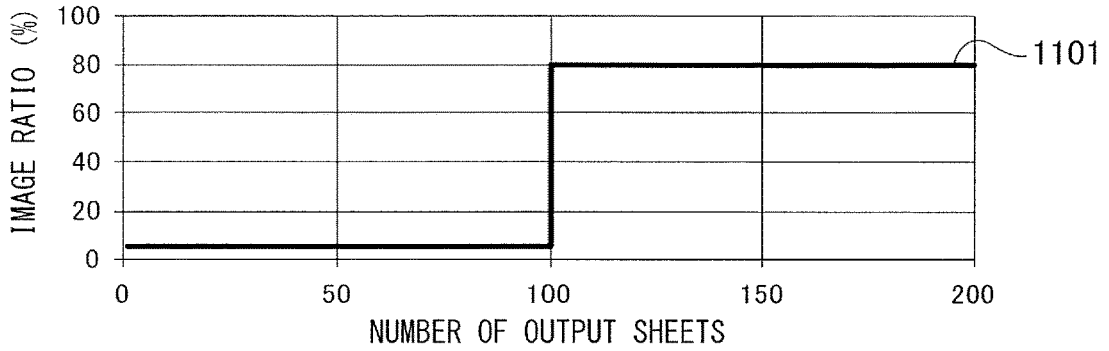
FIGS. 11A to 11D are explanatory diagrams illustrating toner density control in the second exemplary embodiment.
Figure 11B:
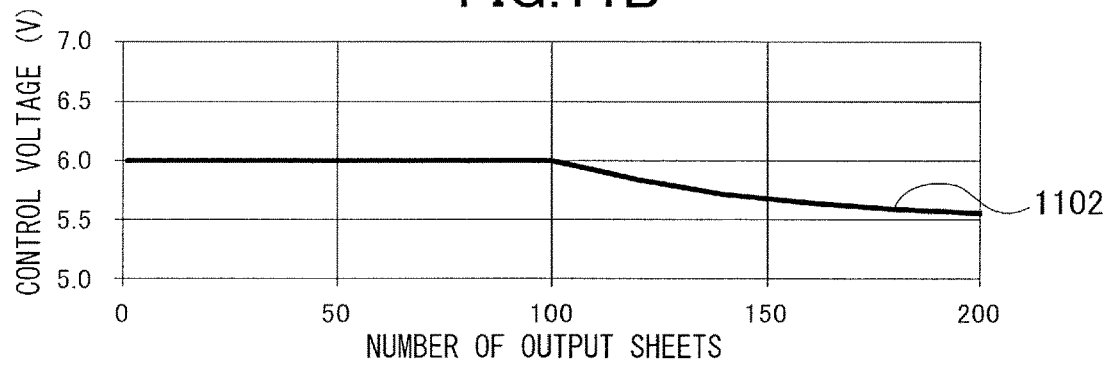
Figure 11C:
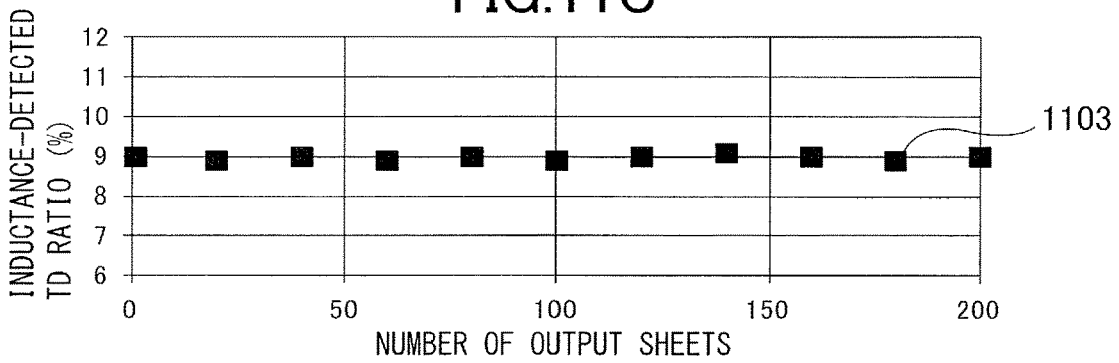
Figure 11D:
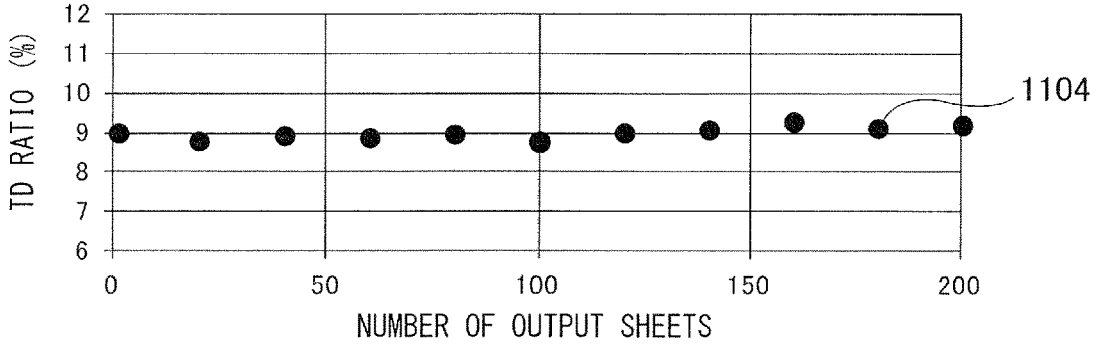

FIG. 11A illustrates a graph 1101 indicating a sequence of image formation in which the image ratio is changed in the same mode as FIGS. 4A and 6A, and FIGS. 11B to 11D illustrate results of controlling the toner supply or the density by the control of FIGS. 9 and 10 in the image formation of FIG. 11A. Among these, FIG. 11B illustrates change in the control voltage of the inductance sensor 26 calculated by using the moving average image ratio of the present exemplary embodiment.

As described above, in the second exemplary embodiment, the moving average image ratio is used as the image ratio used for the control of changing the control voltage of the inductance sensor 26. As a result of this, according to the second exemplary embodiment, the control voltage of the inductance sensor 26 can be gradually changed as indicated by a graph 1102 illustrated in FIG. 11B. Further, the inductance-detected TD ratio calculated on the basis of the detection by the inductance sensor 26 can be stabilized in the vicinity of 9.0% as indicated by a graph 1103 illustrated in FIG. 11C. Therefore, according to the second exemplary embodiment, the error in the supply immediately after changing the image ratio can be effectively suppressed, and thus the TD ratio of the actual toner density in the developing unit 2 can be stabilized in the vicinity of the target TD ratio of 9.0% as indicated by a graph 1104 of FIG. 11D.

Third Exemplary Embodiment

In the first and second exemplary embodiments, control of image formation has been described by using a case where the image ratio is increased from 5% for the 1st to 100th sheets to 80% for the 101st to 200th sheets as an example. However, in reality, the image ratio does not always increase but also sometimes decreases. Therefore, in the third exemplary embodiment, a control method that can deal with change in both directions, that is, increase and decrease, of the image ratio will be exemplified.

FIG. 12 illustrates a case where the image ratio is changed in the both directions of increase and decrease by using the control of the second exemplary embodiment in which the moving average is applied to the image ratio. Here, image formation is performed by changing the image ratio such that the image ratio for the 1st to 100th sheets is 5%, the image ratio for the 101st to 200th sheets is 80%, and the image ratio for the 201st to 400th sheets is 5% as indicated by a graph 1201 illustrated in FIG. 12A. FIG. 12B illustrates a graph 1202 indicating change in the control voltage in this case, FIG. 12C illustrates a graph 1203 indicating change in the inductance-detected TD ratio detected via the inductance sensor 26, and FIG. 12D illustrates a graph 1204 indicating the actual TD ratio of the developer in the developing unit 2. To be noted, in the operation example of FIGS. 12A to 12D, the target TD ratio TD_target is 9.0%, and the humidity value of the temperature/humidity sensor 28 at the time of image formation is constant at 50%.

Figure 12A:
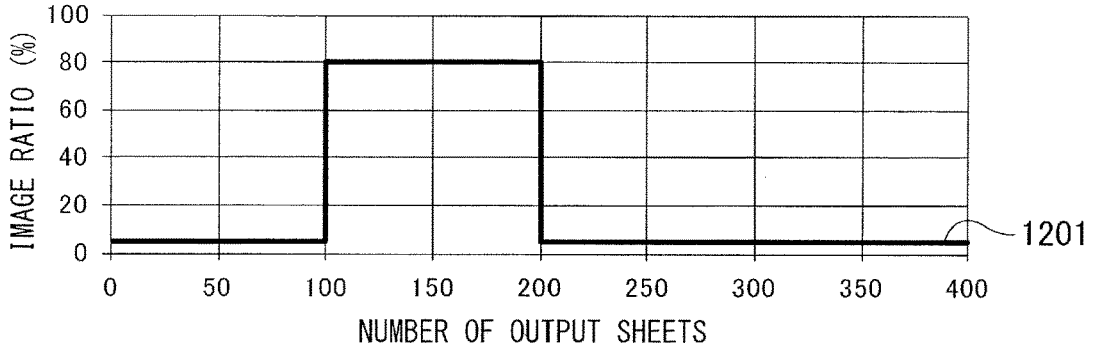
FIGS. 12A to 12D are explanatory diagrams illustrating a phenomenon occurring in the case of increasing and decreasing the image ratio in the control of the second exemplary embodiment.
Figure 12B:
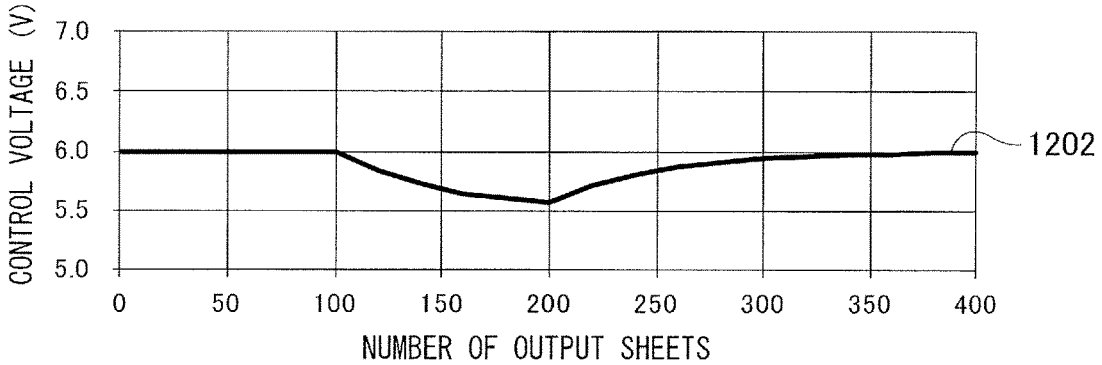
Figure 12C:
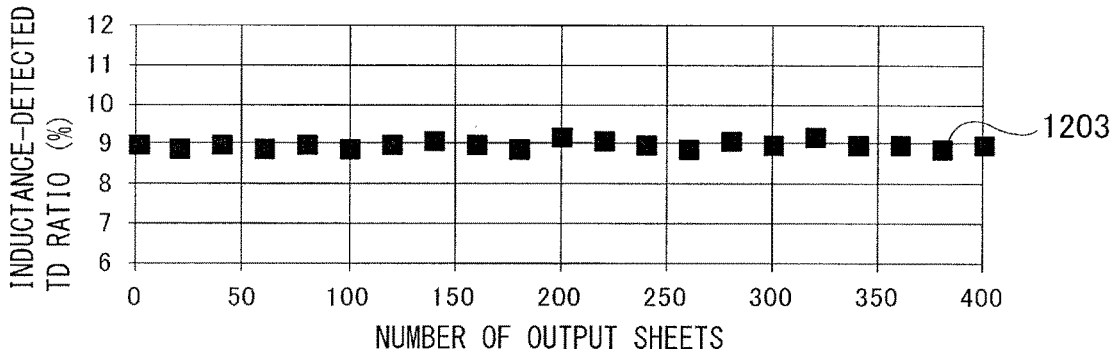
Figure 12D:
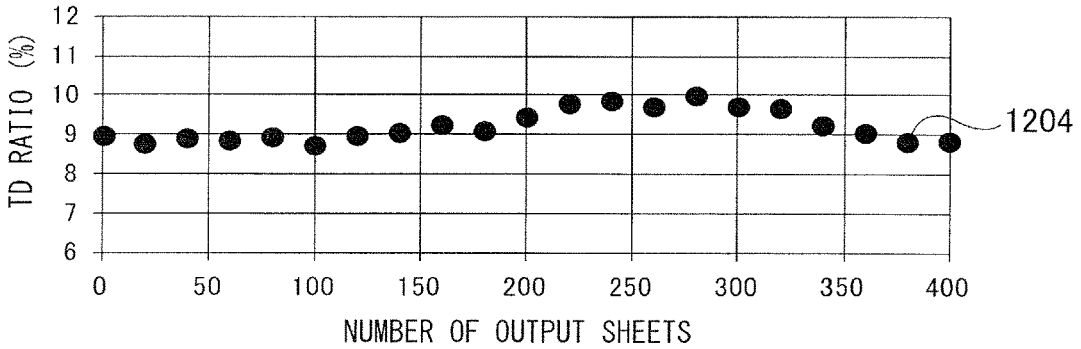

Here, observing FIGS. 12A to 12D, it can be seen that the TD ratio of the developer indicated by a graph 1204 of FIG. 12D increases in the region after the image ratio is decreased at the 201st sheet although the inductance-detected TD ratio is approximately constant as indicated by the graph 1203 illustrated in FIG. 12C. This is because the inclination of decrease of the charge amount of toner at the time of changing the image ratio to the larger value is different from the inclination of increase of the charge amount of toner at the time of changing the image ratio to the smaller value.

Therefore, in the control performed in the third exemplary embodiment, different values are used for the moving average exponent to be applied to the moving average of the image ratio for determining the control voltage of the inductance sensor 26 at the time of changing the image ratio to the larger value and at the time of changing the image ratio to the smaller value.

Figure 13:
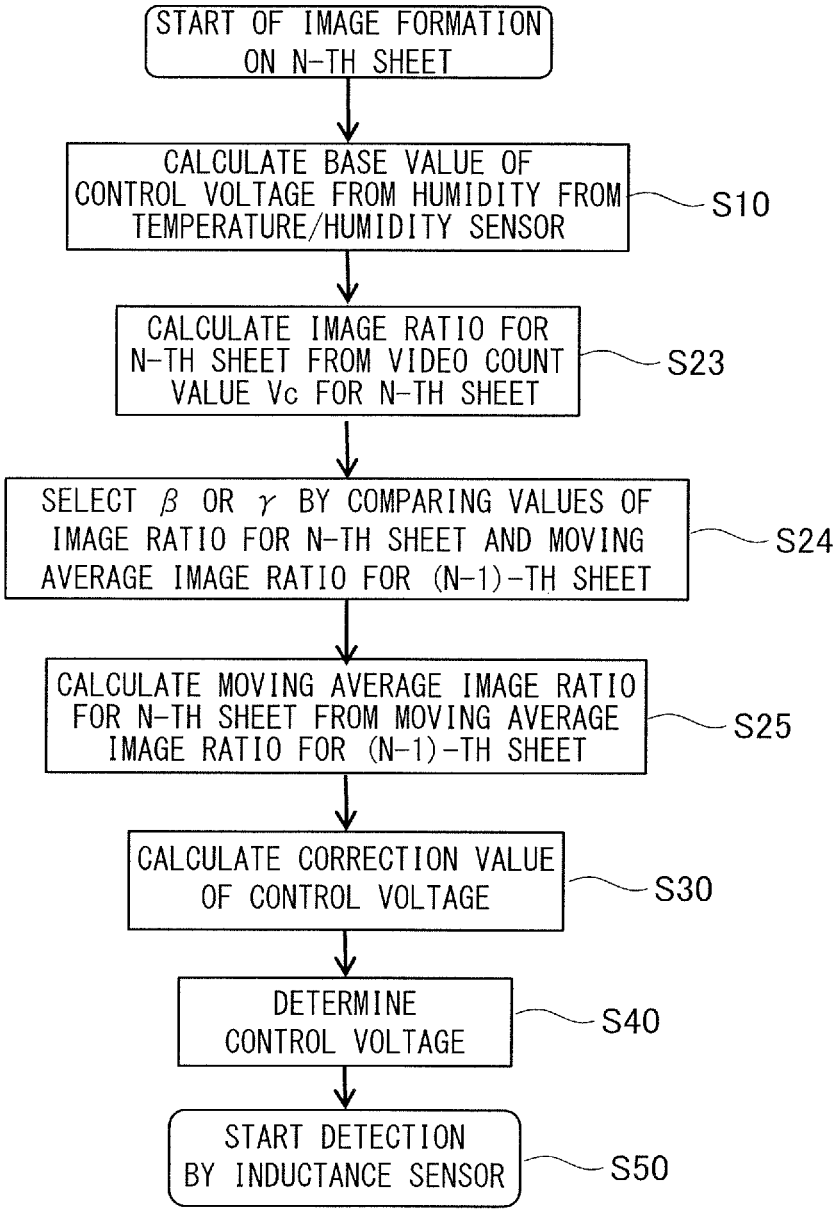
FIG. 13 is a flowchart illustrating a procedure of toner density control in a third exemplary embodiment.

A flowchart of FIG. 13 illustrates a control procedure of the third exemplary embodiment. The difference of the control procedure of FIG. 13 of the third exemplary embodiment from the control procedure of FIG. 9 of the second exemplary embodiment is in steps S23, S24, and S25, and the other steps S10 and S30 to S50 are the same as in FIG. 9. The part different from FIG. 9 in the procedure of FIG. 13 will be mainly described below.

In step S23 of FIG. 13, the image ratio for the N-th sheet is calculated by Expression 6 shown above similarly to step S21 of FIG. 9. Next, in step S24, one of different moving average exponents β and γ is selected in accordance with the magnitude relationship between the image ratio for the N-th sheet and the moving average image ratio for the (N−1)-th sheet, that is, in accordance with the direction of the increase or decrease of the image ratio.

Specifically, the moving average exponent β is selected in the case where the changing direction of the image ratio is an increasing direction, and the moving average exponent γ is selected in the case where the changing direction of the image ratio is a decreasing direction. Here, in the present exemplary embodiment, for example, the moving average exponent β is 50, and the moving average exponent γ is 100. In this case, the calculation of the moving average of the image ratio in step S25 is performed as below by using the selected one of the moving average exponents β and γ.

First, in the case where the image ratio is increased, that is, where the image ratio for the N-th sheet≥the moving average image ratio for the (N−1)-th sheet holds, the moving average exponent β=50 is selected, and the moving average image ratio for the (N−1)-th sheet is calculated by Expression 9 below.

$$\text{(Moving average image ratio for } N\text{-th sheet)}=\text{(Moving average image ratio for } (N-1)\text{-th sheet)}\times(\beta-1)/\beta+\text{(Image ratio} f \text{ for } N\text{-th sheet}/\beta \quad (9)$$

Meanwhile, in the case where the image ratio is decreased, that is, where the image ratio for the N-th sheet<the moving average image ratio for the (N−1)-th sheet holds, the moving average exponent γ=100 is selected, and the moving average image ratio for the (N−1)-th sheet is calculated by Expression 10 below.

$$\text{(Moving average image ratio for } N\text{-th sheet)}=\text{(Moving average image ratio for } (N-1)\text{-th sheet)}\times(\gamma-1)/\gamma+\text{(Image ratio} f \text{ for } N\text{-th sheet}/\gamma \quad (10)$$

That is, the moving average exponent applied to the moving average of the image ratio for determining the control voltage of the inductance sensor 26 is β=50 in the case where there is a tendency that the image ratio is increasing, and this value is equal to α=50 of the second exemplary embodiment. In contrast, in the case where there is a tendency that the image ratio is decreasing, the moving average exponent γ=100 is used. That is, in the case where there is a tendency that the image ratio is decreasing, the moving average exponent γ=100 is used, and the moving average image ratio for the N-th sheet is calculated by assigning a weight of 99/100 to the moving average image ratio for the (N−1)-th sheet and assigning a weight of 1/100 to the image ratio for the N-th sheet. That is, since 1/50>1/100 holds, control is performed such that the image ratio that has changed for the N-th sheet of this time acts with a smaller weight in the case where there is a tendency that the image ratio is decreasing than in the case where there is a tendency that the image ratio is increasing.

Figure 14A:
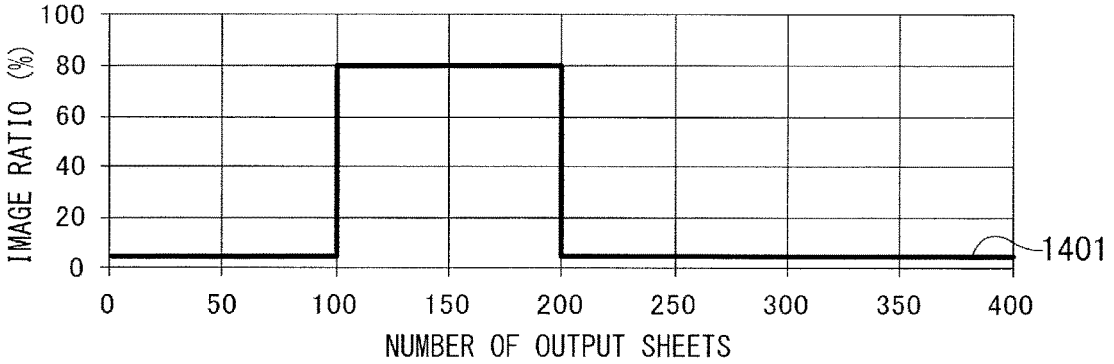
FIGS. 14A to 14D are explanatory diagrams illustrating an effect of control of the third exemplary embodiment.
Figure 14B:
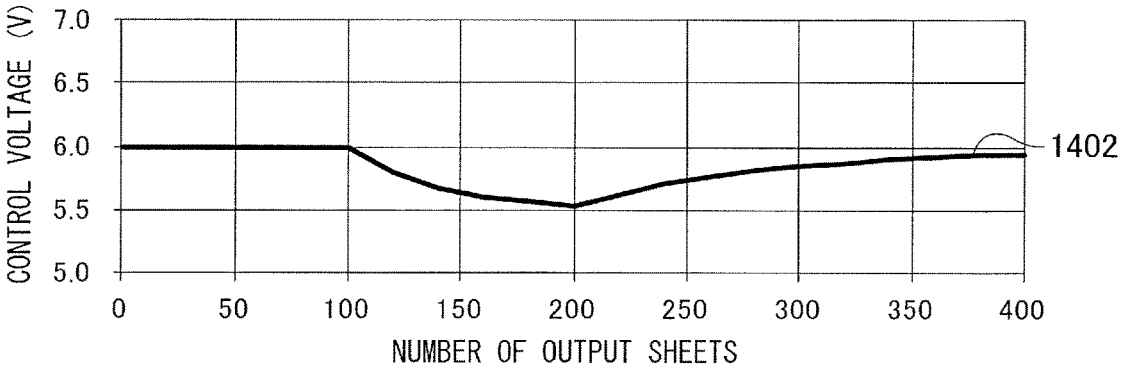
Figure 14C:
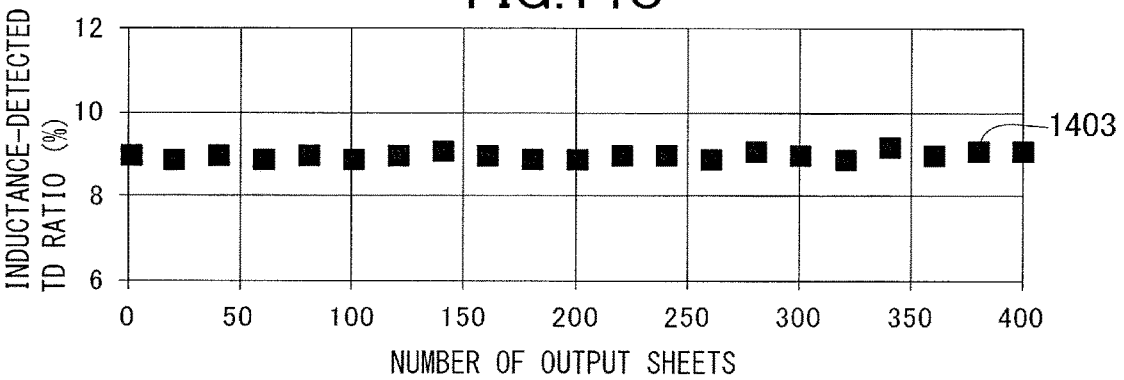
Figure 14D:
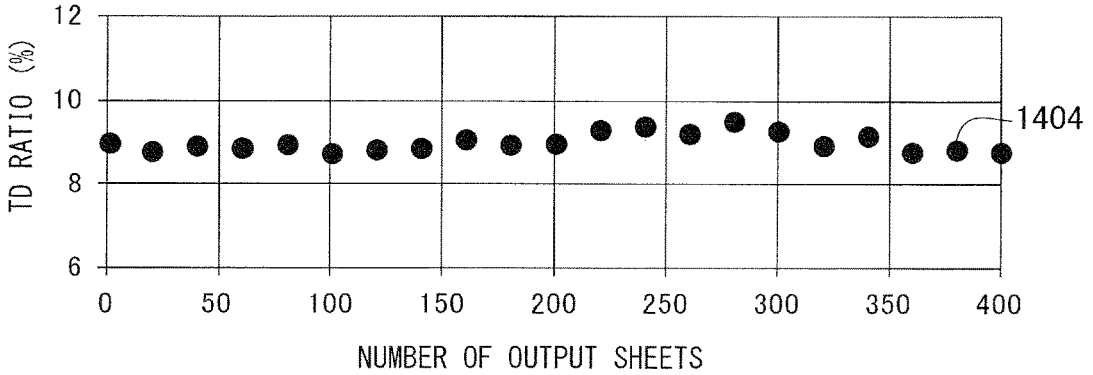

FIGS. 14A to 14D illustrate a result of the control described above illustrated in FIG. 13. The change in the image ratio indicated by a graph 1401 in FIG. 14A is the same mode as the change in the image ratio indicated by the graph 1201 in FIG. 12A. Meanwhile, according to the control of the third exemplary embodiment, the change in the control voltage of the inductance sensor 26 up to the 300th sheet indicated by a graph 1402 illustrated in FIG. 14B after the image ratio is decreased from 80% to 5% at the 201st sheet is more gradual than in FIG. 12B. As a result of this, the inductance-detected TD ratio obtained via the inductance sensor 26 indicated by a graph 1403 illustrated in FIG. 14C and the TD ratio corresponding to the actual toner density of the developer in the developing unit 2 indicated by a graph 1404 illustrated in FIG. 14D are both stabilized in the vicinity of 9%.

As described above, according to the third exemplary embodiment, as the moving average exponent to be applied to the moving average of the image ratio for determining the control voltage of the inductance sensor 26, a different moving average exponent is selected in accordance with the changing direction of the image ratio. As a result of this, as illustrated in FIGS. 14A to 14D, the change in the TD ratio of the developer can be controlled to be stable in both cases of the image ratio being increased and the image ratio being decreased by using different moving average exponents.

Fourth Exemplary Embodiment

In the first to third exemplary embodiments described above, the correction value of the control voltage of the inductance sensor 26 selected in correspondence with the image ratio or the moving average image ratio is calculated by using one functional relationship, for example, as illustrated in FIG. 8.

However, the degree of change in the charge amount of toner, and the change in the bulk density occurring in correspondence therewith vary depending on an environmental condition, for example, the humidity. Therefore, as illustrated in FIG. 15, control may be performed by using a different functional relationship as the functional relationship for determining the correction value of the control voltage from the moving average image ratio or the image ratio depending on the environmental condition, for example, the humidity.

Figure 15:
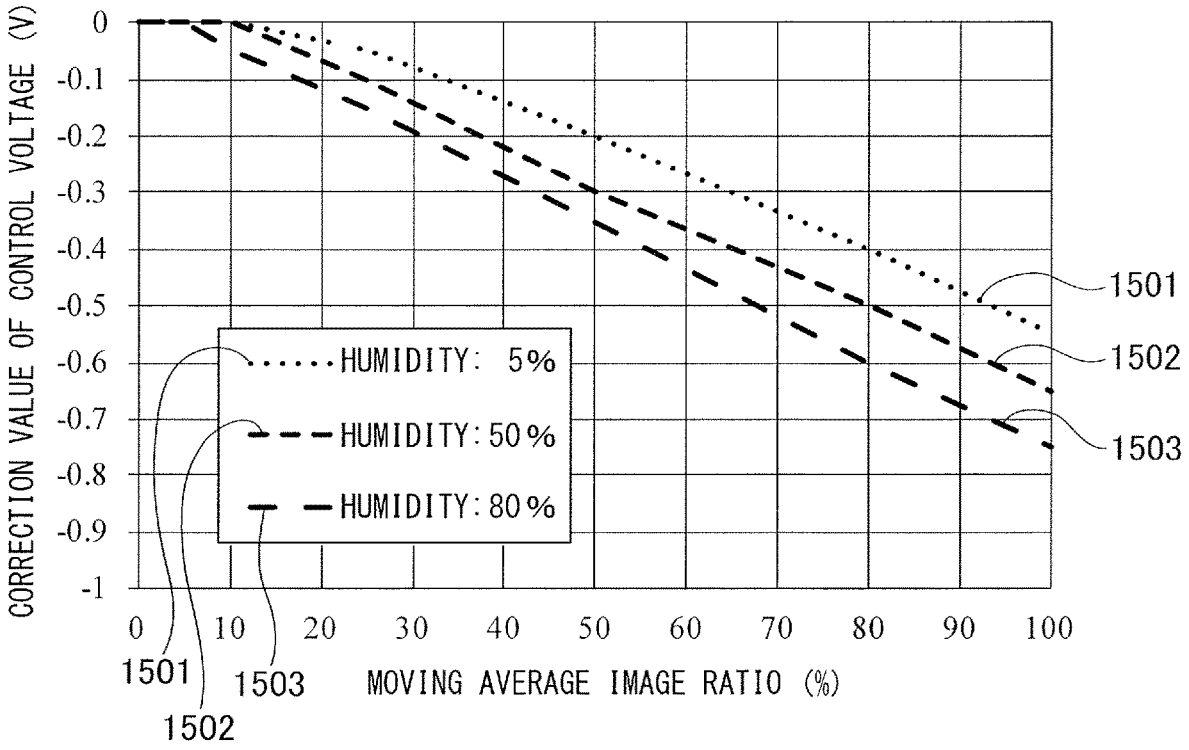
FIG. 15 is an explanatory diagram illustrating an example of setting in the case where a relationship set between a moving average image ratio and a correction value of control voltage is varied for each humidity value detected by a temperature/humidity sensor in a fourth exemplary embodiment.

In FIG. 15, in the case where the humidity value output from the temperature/humidity sensor 28 vary between 5%, 50%, and 80%, the humidity values are associated with the correction value of the control voltage of the inductance sensor 26 corresponding to the moving average image ratio or the image ratio in different functional relationships respectively indicated by graphs 1501, 1502, and 1503. To be noted, three lines of linear functions respectively corresponding to humidity values of 5%, 50%, and 80% are illustrated here for the sake of easier description. However, these lines of linear functions indicated by the graphs 1501 to 1503 may be respectively associated with appropriate ranges centered on these values. Alternatively, the humidity values may be divided into a larger number than the three of 5%, 50%, and 80%, and more functional relationships may be prepared therefor. Further, in the case where the functional relationship associating the moving average image ratio or the image ratio with the correction value of the control voltage is a linear function, that is, a straight line, the inclination thereof may be calculated by the CPU 101 from the humidity value output from the temperature/humidity sensor 28.

A plurality of pieces of functional relationship data that associates the moving average image ratio or the image ratio with the correction value of the control voltage of the inductance sensor 26 as illustrated in FIG. 15 may be stored in the ROM 102 as a data table that can be referred to on the basis of the image ratio. For example, which of the plurality of pieces of functional relationship data of FIG. 15 is used can be simultaneously determined when the CPU 101 refers to the humidity value output from the temperature/humidity sensor 28 to determine the base value of the control voltage in step S10 of FIGS. 7, 9, and 13.

As described above, according to the fourth exemplary embodiment, control is performed to use a different functional relationship as the functional relationship for determining the correction value of the control voltage of the inductance sensor 26 from the moving average image ratio or the image ratio in accordance with the environmental condition, for example, the humidity. As a result of this, the control voltage of the inductance sensor 26 can be appropriately controlled in accordance with, for example, the humidity, and the inductance-detected TD ratio obtained via the inductance sensor 26 can be stably controlled.

In the exemplary embodiments described above, configurations of correcting the control voltage have been described. As another method, the configuration may be a configuration of adjusting the inductance-detected TD ratio obtained via the inductance sensor 26 without changing the control voltage by using the image ratio. Specifically, as described with reference to FIGS. 4C and 4D, in the case where the image ratio is larger than a predetermined value, the inductance-detected TD ratio appears smaller than the actual state in the developing unit 2. Therefore, for example, a function of an adjustment portion that adjusts the inductance-detected TD ratio to a larger value in the case where the calculated image ratio is larger than a predetermined image ratio is provided in the CPU 101. Further, the control of supply of the developer is performed in a first supply mode based on the inductance-detected TD ratio obtained via the inductance sensor 26 in the case where the image ratio is smaller than a predetermined value, and in a second supply mode based on a TD ratio adjusted by the adjustment portion in the case where the image ratio is larger than the predetermined value. To be noted, any of the methods of calculation of the first to third exemplary embodiments may be applied to calculation of the image ratio.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-086007, filed Apr. 25, 2017, which is hereby incorporated by reference herein in its entirety.

What is claimed is:

1. An image forming apparatus comprising:

an image bearing member on which an electrostatic image is to be formed;

a developing unit comprising a developer bearing member configured to carry and convey developer comprising toner and carrier to develop the electrostatic image, the developing unit being configured to accommodate the developer;

an inductance sensor configured to output a voltage value corresponding to a density of the toner in the developer in the developing unit;

a calculation portion configured to calculate an averaged image ratio of a predetermined number of electrostatic images to be formed on the image bearing member;

a developer supplying portion configured to supply the developer to the developing unit;

a controller configured to control the developer supplied from the developer supplying portion to the developing unit on a basis of the density of the toner output from the inductance sensor; and a voltage controller configured to control a voltage value for adjusting a magnitude of a magnetic field of the inductance sensor such that an absolute value of the voltage for adjusting the magnitude of the magnetic field of the inductance sensor in a case where the averaged image ratio calculated by the calculation portion is a second image ratio larger than a first image ratio is smaller than an absolute value of the voltage for adjusting the magnitude of the magnetic field of the inductance sensor in a case where the averaged image ratio calculated by the calculation portion is the first image ratio.

2. The image forming apparatus according to claim 1, wherein the averaged image ratio calculated by the calculation portion is an adjusted moving average of image ratios of the predetermined number of images.

3. The image forming apparatus according to claim 1, wherein the averaged image ratio calculated by the calculation portion is an exponential moving average of image ratios of the predetermined number of images.

4. The image forming apparatus according to claim 1, wherein the controller controls an amount of supply of the developer such that the density of the toner output from the inductance sensor is within a predetermined range.

5. An image forming apparatus comprising:

an image bearing member on which an electrostatic image is to be formed;

a developing unit comprising a developer bearing member configured to carry and convey developer comprising toner and carrier to develop the electrostatic image, the developing unit being configured to accommodate the developer;

a toner density detection portion configured to detect a density of the toner in the developer in the developing unit;

a calculation portion configured to calculate an averaged image ratio of a predetermined number of electrostatic images to be formed on the image bearing member;

an adjustment portion configured to adjust the density of the toner output from the toner density detection portion such that a value of the density of the toner output from the toner density detection portion in a case where the averaged image ratio calculated by the calculation portion is higher than a predetermined image ratio is higher than a value of the density of the toner output from the toner detection portion in a case where the averaged image ratio calculated by the calculation portion is lower than the predetermined image ratio;

a developer supplying portion configured to supply the developer to the developing unit; and a controller configured to selectively execute one of a first supply mode and a second supply mode, wherein, in the first supply mode, the controller controls the developer to be supplied from the developer supplying portion to the developing unit on a basis of the density of the toner output from the toner density detection portion that has not been adjusted by the adjustment portion, and wherein, in the second supply mode, the controller controls the developer to be supplied from the developer supplying portion to the developing unit on a basis of the density of the toner output from the toner density detection portion that has been adjusted by the adjustment portion.

6. The image forming apparatus according to claim 5, wherein the averaged image ratio calculated by the calculation portion is an adjusted moving average of image ratios of the predetermined number of images.

7. The image forming apparatus according to claim 5, wherein the averaged image ratio calculated by the calculation portion is an exponential moving average of image ratios of the predetermined number of images.

8. The image forming apparatus according to claim 5, wherein the toner density detection portion is an inductance sensor.

9. An image forming apparatus comprising:

an image bearing member on which an electrostatic image is to be formed;

a developing unit comprising a developer bearing member configured to carry and convey developer comprising toner and carrier to develop the electrostatic image, the developing unit being configured to accommodate the developer;

an inductance sensor configured to output a voltage value corresponding to a density of the toner in the developer in the developing unit;

a developer supplying portion configured to supply the developer to the developing unit;

a controller configured to control the developer supplied from the developer supplying portion to the developing unit on a basis of the density of the toner output from the inductance sensor; and a voltage controller configured to control a voltage value for adjusting a magnitude of a magnetic field of the inductance sensor such that an absolute value of the voltage for adjusting the magnitude of the magnetic field of the inductance sensor in a case where images of a second image ratio larger than a first image ratio are successively formed is smaller than an absolute value of the voltage for adjusting the magnitude of the magnetic field of the inductance sensor in a case where images of the first image ratio are successively formed.

10. The image forming apparatus according to claim 9, wherein the first image ratio is smaller than 10%.

11. An image forming apparatus comprising:

an image bearing member on which an electrostatic image is to be formed;

a developing unit comprising a developer bearing member configured to carry and convey developer comprising toner and carrier to develop the electrostatic image, the developing unit being configured to accommodate the developer;

an inductance sensor configured to output a voltage value corresponding to a density of the toner in the developer in the developing unit;

a developer supplying portion configured to supply the developer to the developing unit;

a controller configured to control the developer supplied from the developer supplying portion to the developing unit on a basis of the density of the toner output from the inductance sensor; and a voltage controller configured to control a voltage value for adjusting a magnitude of a magnetic field of the inductance sensor such that an absolute value of the voltage for adjusting the magnitude of the magnetic field of the inductance sensor in a case where an image ratio of the electrostatic image to be formed on the image bearing member is a second image ratio larger than a first image ratio is smaller than an absolute value of the voltage for adjusting the magnitude of the magnetic field of the inductance sensor in a case where the image ratio of the electrostatic image to be formed on the image bearing member is the first image ratio.

12. An image forming apparatus comprising:

an image bearing member on which an electrostatic image is to be formed;

a developing unit comprising a developer bearing member configured to carry and convey developer comprising toner and carrier to develop the electrostatic image, the developing unit being configured to accommodate the developer;

a toner density detection portion configured to detect a density of the toner in the developer in the developing unit;

an adjustment portion configured to adjust the density of the toner output from the toner detection portion such that a value of the density of the toner output from the toner density detection portion in a case where an image ratio of the electrostatic image to be formed on the image bearing member is higher than a predetermined image ratio is higher than a value of the density of the toner output from the toner density detection portion in a case where the image ratio of the electrostatic image to be formed on the image bearing member is lower than the predetermined image ratio;

a developer supplying portion configured to supply the developer to the developing unit; and a controller configured to selectively execute one of a first supply mode and a second supply mode, wherein, in the first supply mode, the controller controls the developer to be supplied from the developer supplying portion to the developing unit on a basis of the density of the toner output from the toner density detection portion that has not been adjusted by the adjustment portion, and wherein, in the second supply mode, the controller controls the developer to be supplied from the developer supplying portion to the developing unit on a basis of the density of the toner output from the toner density detection portion that has been adjusted by the adjustment portion.

13. The image forming apparatus according to claim 12, wherein the toner density detection portion is an inductance sensor.

* * * * *